US010431130B2

(12) United States Patent
McPhillips

(10) Patent No.: US 10,431,130 B2
(45) Date of Patent: Oct. 1, 2019

(54) DISPLAY SYSTEM

(71) Applicant: Atomic Design Inc., Lititz, PA (US)

(72) Inventor: Thomas McPhillips, Manheim, PA (US)

(73) Assignee: Atomic Design Inc., Lititz, PA (US)

( * ) Notice: Subject to any disclaimer, the term of this patent is extended or adjusted under 35 U.S.C. 154(b) by 700 days.

(21) Appl. No.: 14/964,760

(22) Filed: Dec. 10, 2015

(65) Prior Publication Data

US 2017/0171991 A1 Jun. 15, 2017

(51) Int. Cl.
*G09F 9/302* (2006.01)
*G09F 15/00* (2006.01)

(52) U.S. Cl.
CPC ..... *G09F 9/3026* (2013.01); *G09F 15/0068* (2013.01)

(58) Field of Classification Search
CPC ..... G09F 9/3026; G09F 15/0068; A47F 5/105
See application file for complete search history.

(56) References Cited

U.S. PATENT DOCUMENTS 892,615 A * 7/1908 Perry et al. ..... G09F 15/0068 160/351
15,255,515 2/1925 Socha
2,692,689 A 10/1954 Wynne, Sr.
2,921,347 A * 1/1960 Solomon ..... A47F 5/10 16/108
2,970,396 A 2/1961 Worrell
3,174,629 A * 3/1965 Gelberg ..... A47F 5/105 108/11
3,192,820 A 7/1965 Pitzer
3,426,913 A 2/1969 Abatiell, Jr.
3,537,199 A 11/1970 Lawson
3,571,999 A 3/1971 Downing
3,593,474 A 7/1971 Neels
3,596,701 A 8/1971 Cowan
3,936,111 A 2/1976 Mazzucconi
4,001,987 A 1/1977 Coulthard
4,114,160 A 9/1978 Verini
4,471,548 A * 9/1984 Goudie ..... E04H 12/182 40/610
4,479,340 A * 10/1984 Alphonse ..... F16B 21/086 248/165

(Continued)

FOREIGN PATENT DOCUMENTS

AU 2012261483 A1 6/2013
CA 1263233 A1 11/1989

(Continued)

OTHER PUBLICATIONS

Installation Instructions for Pillow Wall, by Atomic, www.atomicrental.tv, (717-626-4408), dated Nov. 25, 2013, 1 page.

(Continued)

*Primary Examiner* — Stanton L Krycinski
(74) *Attorney, Agent, or Firm* — Barley Snyder

(57) ABSTRACT

A display system is provided and includes a first modular panel having a display element, a plurality of first connectors connected to the first modular panel, a plurality of first rods having a distal end connected to the plurality of first connectors, and a plurality of second connectors engaging with proximal ends of the plurality of first rods.

34 Claims, 21 Drawing Sheets

(56) References Cited

U.S. PATENT DOCUMENTS 4,512,097 A * 4/1985 Zeigler ..... G09F 7/18 40/610
4,516,619 A * 5/1985 Hasbrouck ..... E04B 2/7425 160/135
4,522,008 A * 6/1985 Zeigler ..... E04B 1/34326 24/306
4,637,180 A * 1/1987 Zeigler ..... E04B 1/34326 24/113 R
4,658,560 A * 4/1987 Beaulieu ..... E04B 1/19 211/182
4,747,239 A * 5/1988 Zeigler ..... G09F 15/0068 52/109
4,800,663 A * 1/1989 Zeigler ..... G09F 7/12 40/610
4,807,837 A 2/1989 Gawlik et al.
4,809,471 A * 3/1989 Wichman ..... A47F 5/14 52/109
4,888,895 A * 12/1989 Kemeny ..... G09F 15/0068 40/610
D307,448 S 4/1990 Akard
4,942,686 A * 7/1990 Kemeny ..... G09F 15/0068 40/610
4,986,016 A * 1/1991 Wichman ..... E04B 1/3441 40/610
5,036,641 A 8/1991 Viry
5,061,018 A 10/1991 Pederson et al.
5,111,631 A * 5/1992 Flood ..... A47F 5/14 52/646
5,125,205 A * 6/1992 Wichman ..... A47F 5/13 40/610
5,148,648 A * 9/1992 Sorenson ..... E04B 1/1903 403/176
5,203,126 A * 4/1993 Sorenson ..... G09F 15/0068 135/147
5,203,134 A * 4/1993 Sorenson ..... G09F 15/0068 403/172
5,230,196 A * 7/1993 Zeigler ..... E04B 1/3211 52/108
5,344,115 A 9/1994 Mayne et al.
5,351,843 A * 10/1994 Wichman ..... E04H 12/185 211/182
5,478,041 A 12/1995 Mayne
5,501,051 A * 3/1996 Harlan ..... G09F 15/0068 160/135
5,590,921 A 1/1997 Holtman et al.
5,671,852 A 9/1997 Maharg
5,722,477 A 3/1998 Richter et al.
5,826,397 A * 10/1998 Armold ..... G09F 15/0068 52/646
5,947,356 A 9/1999 Delong
5,993,287 A 11/1999 Melashenko et al.
6,250,039 B1 * 6/2001 Karten ..... G09F 15/0068 40/610
6,340,046 B1 1/2002 Basseches
6,370,803 B1 4/2002 Burquest
6,419,332 B1 7/2002 Caldwell, Jr. et al.
6,553,698 B1 * 4/2003 Kemeny ..... G09F 15/0068 160/135
6,591,571 B2 * 7/2003 Fritsche ..... G09F 15/0062 403/170
6,702,640 B1 3/2004 Park
6,718,709 B2 4/2004 Koutras et al.
6,758,354 B2 * 7/2004 Carletti ..... G09F 15/0068 211/182
6,799,594 B2 * 10/2004 Kuo ..... E04H 12/10 135/120.3
6,829,869 B1 * 12/2004 Savoie ..... G09F 15/0068 135/122
6,983,853 B1 1/2006 Fickett
D515,252 S 2/2006 Dumbrell
D562,113 S 2/2008 Ciungan et al.
D618,282 S 6/2010 Kosir
D624,461 S 9/2010 Noble et al.
7,874,090 B2 1/2011 Flagg
D634,745 S 3/2011 Park et al.
3,069,632 A1 12/2011 Piao-Chin Li
8,083,189 B2 12/2011 Sun et al.
D708,504 S 7/2014 Kaplan
D709,203 S 7/2014 Shikata
D736,858 S 8/2015 McPhillips
9,254,051 B2 * 2/2016 McPhillips ..... G09F 15/00
2002/0036908 A1 3/2002 Pederson
2002/0154789 A1 10/2002 Rodgers
2003/0000904 A1 1/2003 Lung et al.
2003/0192271 A1 10/2003 Koutras et al.
2004/0035987 A1 2/2004 Oddsen, Jr.
2004/0089782 A1 5/2004 Eliason et al.
2005/0007031 A1 1/2005 Hyder
2007/0107853 A1 5/2007 Hsieh
2009/0134285 A1 5/2009 Huang
2009/0196034 A1 8/2009 Gherardini et al.
2012/0169999 A1 7/2012 Cavendish et al.
2013/0260362 A1 * 10/2013 Melashenko ..... G09B 19/00 434/430
2014/0047747 A1 2/2014 Jackson
2014/0183309 A1 7/2014 Pasho
2014/0197123 A1 7/2014 McPhillips
2014/0197124 A1 * 7/2014 McPhillips ..... G09F 15/0068 211/195

FOREIGN PATENT DOCUMENTS

CA 2114767 A1 * 8/1995 ..... A47B 43/00
DE 8517546.3 U1 1/1985
DE 9114203 U1 * 6/1992 ..... A47F 5/105
DE 29820223 U1 2/1999
DE 10138986 A 3/2003
DE 102011015351 A1 10/2012
EP 0663484 A1 * 7/1995 ..... E04B 2/7431
EP 1443155 A2 * 8/2004 ..... G09F 15/0068
EP 1995508 A2 11/2008
FR 2590144 A1 * 5/1987 ..... A47F 5/13
FR 2622674 A1 * 5/1989 ..... B65D 25/205
FR 2796703 A1 * 1/2001 ..... E04B 1/3441
FR 2805069 A1 * 8/2001 ..... G09F 15/0025
FR 2817074 A1 * 5/2002 ..... G09F 15/0062
FR 2824461 A1 * 11/2002 ..... G09F 15/0068
FR 2851442 A1 2/2003
GB 2130780 A * 6/1984 ..... G09F 15/0068
WO WO-9703430 A1 * 1/1997 ..... G09F 15/0068
WO WO-0195299 A1 * 12/2001 ..... E04B 1/3441
WO WO-02059863 A1 * 8/2002 ..... G09F 15/0025

OTHER PUBLICATIONS

PCT Notification and International Preliminary Report on Patentability, Application No. PCT/US2014/011055, dated Jul. 14, 2015, 7 pages.
PCT Notification, International Search Report, International Application No. PCT/US2014/061074, dated Feb. 25, 2015, 12 pages.
PCT Notification, International Search Report and Written Opinion, International Application No. PCT/US2014/011055, dated Jun. 2, 2014, 10 pages.
PCT Search Report and Written Opinion, International Application No. PCT/US2015/031782, dated Aug. 14, 2015, 11 pages.
PCT Notification of Transmittal of International Preliminary Report on Patentability, International Application No. PCT/US2014/061074, dated Apr. 28, 2016, 1 page.
PCT International Preliminary Report on Patentability, International Application No. PCT/US2014/061074, dated Apr. 19, 2016, 7 pages.
Attachment 1, Installation Instructions, Swell Latch Installation Instructions, Innovative Components, dated Jun. 16, 2009, 1 page.

* cited by examiner

FIG. 26
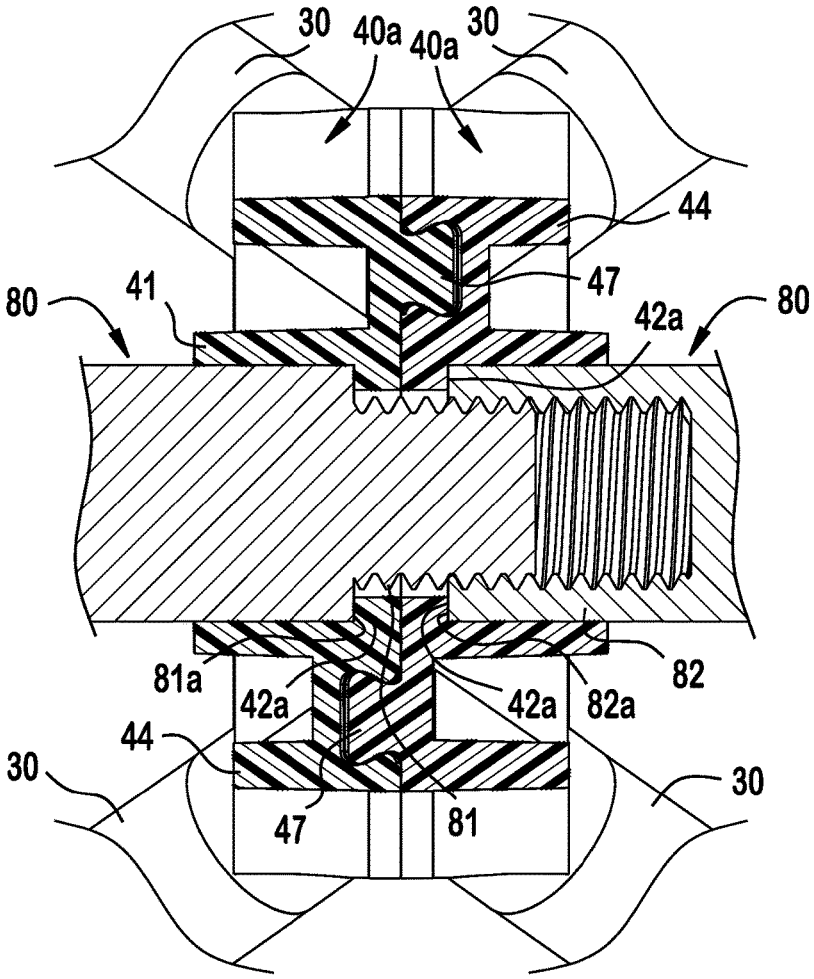
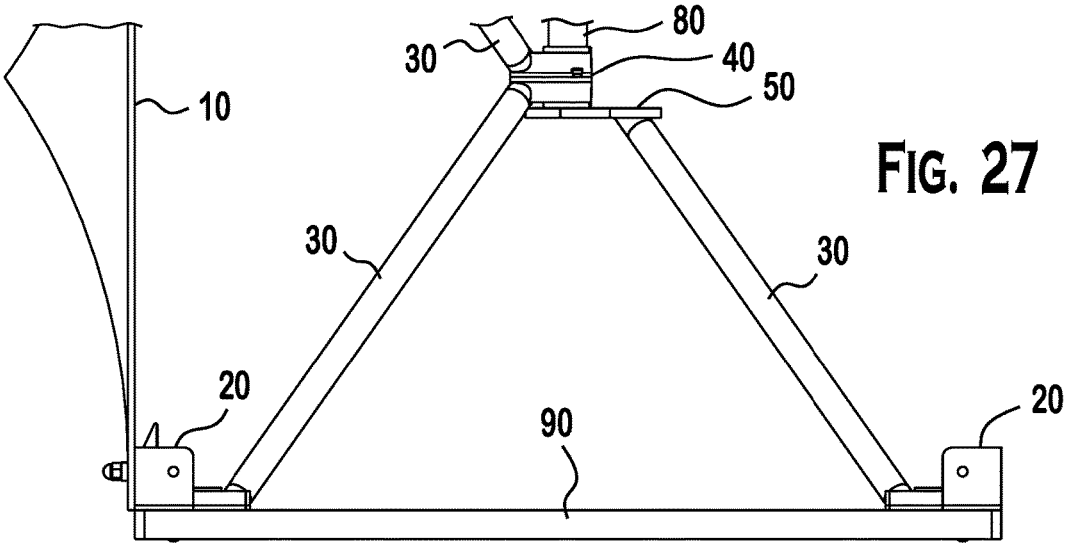
FIG. 27

DISPLAY SYSTEM

FIELD OF THE INVENTION

The invention relates to a display system and, more particularly, to a portable display system for connecting a plurality of modular units.

BACKGROUND

Decorative modular displays are commonly used in stage and set design. Generally, modular units are hung from a hanging frame using backdrop technology. A known modular display system uses a truss or theatre fly-system pipes to hang modular panels that clip together using rings or hooks to form a backdrop, which results is a decorative surface that is aesthetic while also increasing the range of available lighting effects. The backdrop is sized to fit the space required. In some circumstances, a floor system may be used instead of a truss and/or backdrop. In the known floor display system, a temporary structure is set up from the floor, rather than suspended from the ceiling. The known floor display system includes metal pipes or tubes that connect to each other and the modular units hang from these metal pipes or tubes. Additionally, when using these pipes in the known display system, connecting pipes are commonly over tightened and damaged, and the modular units attached to the pipes are restricted from free movement about the pipe.

In both known display systems, the display systems are restricted from free movement of the display or individual modular units. Furthermore, these known display systems include complex or permanent attachment mechanisms to connect one modular unit to an adjacent modular unit. Such attachment restricts replacement of each modular unit and limits the flexibility of the entire display system. These known designs are expensive and require tedious, time-consuming labor in both assembly and dis-assembly. It has long been desired to have a modular display system that can be quickly constructed and deconstructed without sacrificing the structural integrity of the system.

SUMMARY

Accordingly, a display system is provided. The display system includes a first modular panel having a display element, a plurality of first connectors connected to the first modular panel, a plurality of first rods having a distal end connected to the plurality of first connectors, and a plurality of second connectors engaging with proximal ends of the plurality of first rods.

BRIEF DESCRIPTION OF THE DRAWINGS

The invention will now be described by way of example with reference to the accompanying figures, of which:

FIG. 26 is a sectional view of the plurality of second connectors of FIG. 24, taken along line 26-26;

FIG. 27 is a side view of a plurality of second connectors and a third connector of a modular display system according to the invention;

DETAILED DESCRIPTION OF THE EMBODIMENT(S)

The invention is explained in greater detail below with reference to embodiments of a modular display system. The invention, may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
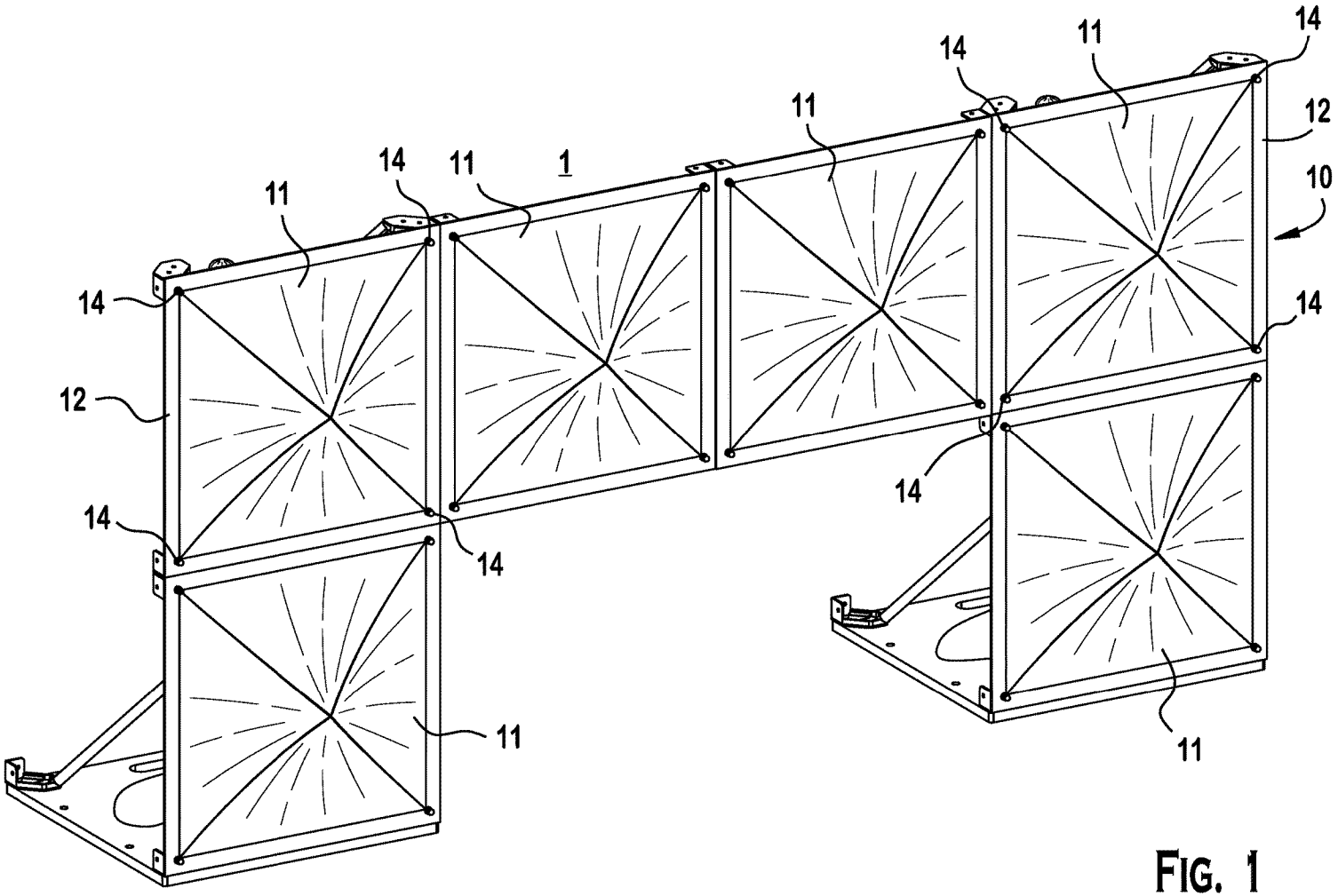
FIG. 1 is a front perspective view of a modular display system according to the invention.
Figure 2:
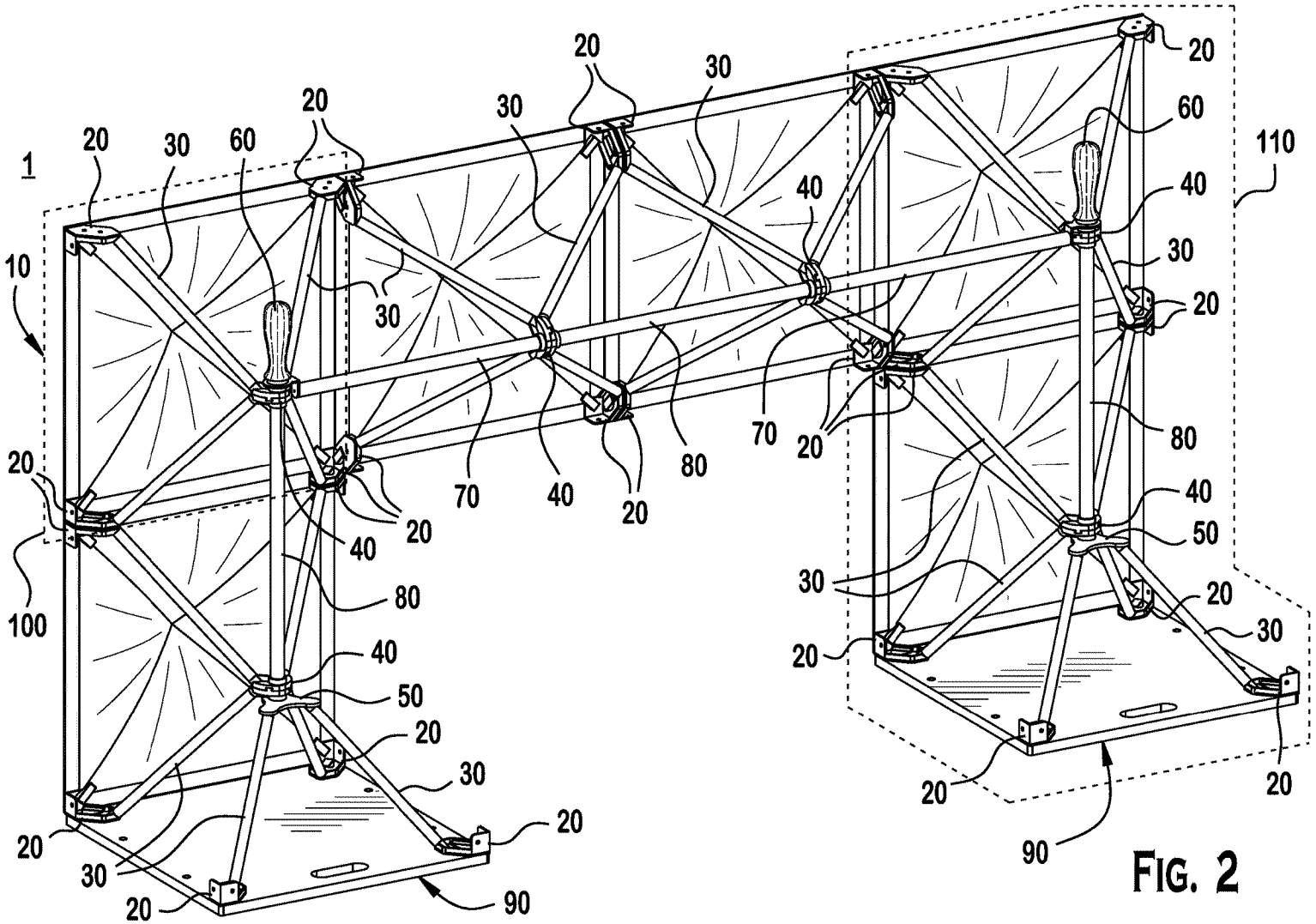
FIG. 2 is a rear perspective view of the modular display system of FIG. 1.

A modular display system 1 according to an embodiment of the invention is shown in FIGS. 1 and 2. In the shown embodiment, the display system 1 includes the following major components: a plurality of modular panels 10, a plurality of first connectors 20, a plurality of first rods 30, a plurality of second connectors 40, a plurality of third connectors 50, a plurality of end members 60, a plurality of second rods 70, a plurality of third rods 80, a plurality of bases 90, and a plurality of fasteners 100.

As shown in FIG. 1, the display system 1 includes a plurality of modular panels 10 positioned adjacent to one another. Each modular panel 10 includes a display element 12 and a connection element 14. In the shown embodiment, each modular panel 10 is square shaped. However, one skilled in the art should appreciate that other designs are possible, as long as such design and shape would permit modular assembly and connection. Additionally, each display element 12 can be any size, texture, or material suitable for a particular display system use. As shown, each connection element 14 includes a plurality of fastener receiving passageways 16 which is a through receiving passageway extending through a body of the modular panel 10. In the shown embodiment, each fastener receiving passageway 16 is positioned along corners of the squared shaped modular panel 10. However, one skilled in the art should appreciate that the fastener receiving passageways 16 may be positioned at different locations along the perimeter of the modular panel 10.

Figure 3:
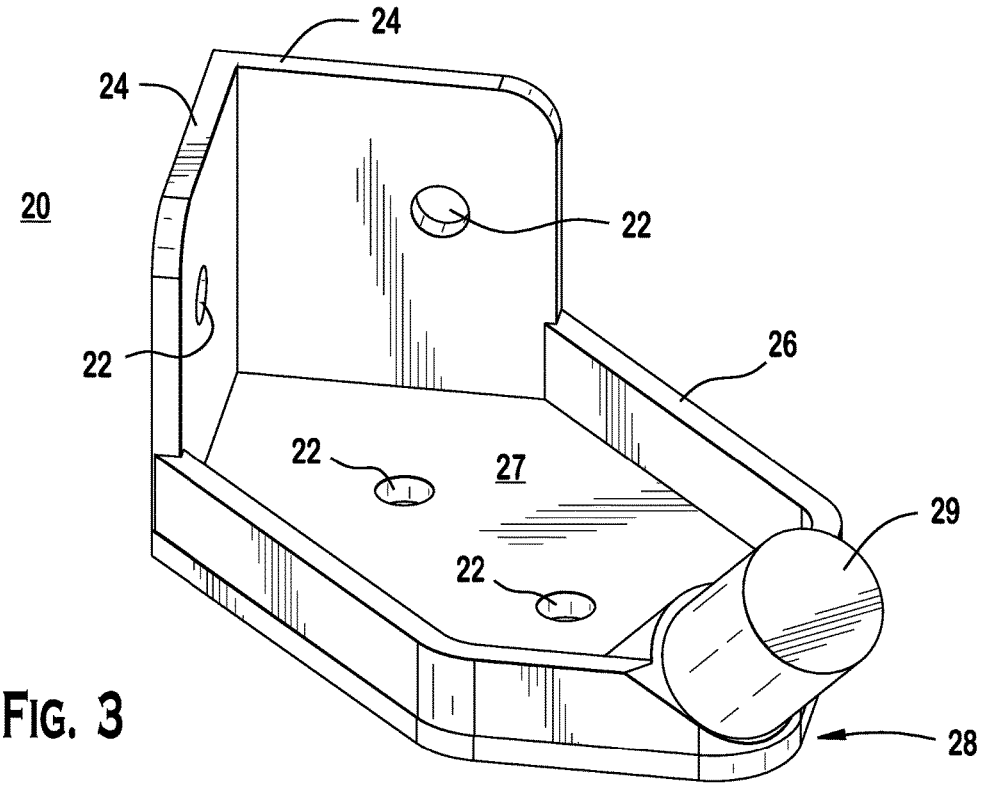
FIG. 3 is a perspective view of a first connector of the modular display system according to the invention.
Figure 4:
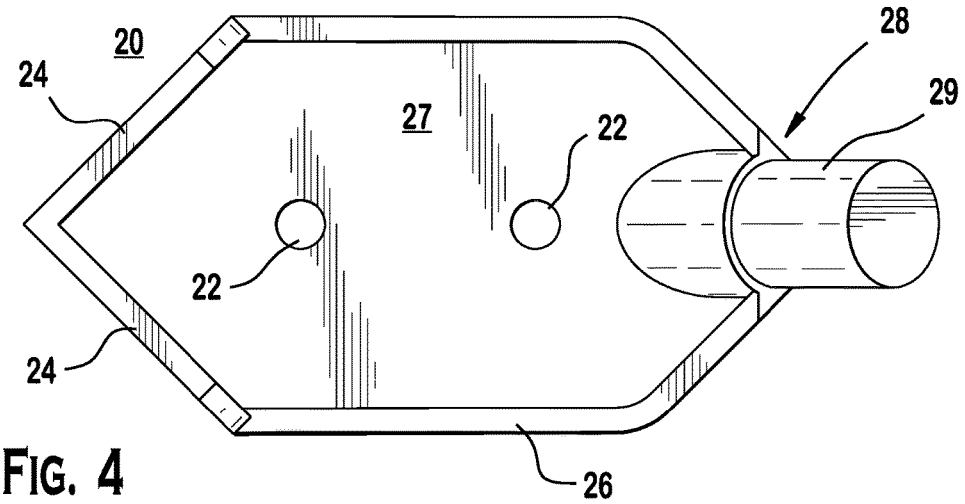
FIG. 4 is a top view of the first connector of FIG. 3.

Now with reference to FIGS. 3 and 4, the first connectors 20 will be described. As shown, each first connector 20 includes a pair of support walls 24, a base 27, fastener receiving passageways 22, an outer edge wall 26, and a support connector 28. The elements of the first connector 20 can be formed out of any structural materials such as metal, fibrous material, plastic, or material composite.

The support walls 24 are formed along a distal end of the first connector 20. The pair of support walls 24 are positioned orthogonal to each other and each include a fastener receiving passageway 22. In the shown embodiment, each support wall 24 includes a fastener receiving passageway 22, but one skilled in the art should appreciate that other designs are possible as long as such design and shape would permit modular assembly and connection. Furthermore, in the shown embodiment, each support wall 24 is square shaped, but one skilled in the art should appreciate that other designs are possible.

The base 27 is a surface extending between the distal and proximal ends of the first connector 20. The base 27 is positioned orthogonal to the support walls 24, and includes at least one fastener receiving passageway 22. In the shown embodiment, the base has two fastener receiving passageways 22, but one skilled in the art should appreciate that any number of fastener receiving passageways could be used. Furthermore, while the base 27 is hexagonal shaped in the shown embodiment, one with skill in the art would appreciate that the base 27 could be any shape that permits the described elements and connections.

An outer edge wall 26, also positioned orthogonal to the base 27, extends around the perimeter of the base 27 between the proximal and distal ends of the first connector 20. In the shown embodiment, the support walls 24 extend further upward from the base 27 than the outer edge wall 26, but one skilled in the art should appreciate that the outer edge wall 26 could have a range of relative heights with respect to support wall 24.

The support connector 28 extends from the proximal end of the first connector 20 at an angle with respect to the base 27. The angle of the support connector 28 with respect to the base may be less than 90°, is optionally between 30° and 60°, and further is optionally 45°. The support connectors 28 can be solid or hollow. In the shown embodiment, each support connector 28 is cylindrical. However, one skilled in the art should appreciate that other polygonal shapes are possible without departing from the spirit of the invention.

Now with reference to FIGS. 2, 5, and 6, the first rods 30 will be described. Each first rod 30 is an elongated hollow body with two opposite, identical ends. In the shown embodiment, the first rod 30 is cylindrical, but one skilled in the art should appreciate that other designs are possible as long as such design and shape would permit modular assembly and connection.

Now with reference to FIGS. 7-9, the second connector 40 will be described. As shown, the second connector 40 is a monolithic plastic article. However, one skilled in the art should appreciate that the second connector 40 could be prepared from other known materials available to one skilled in the art, including metals, fibrous material, or composites. In an alternative embodiment, the second connector 40 could be formed from separate pieces which are then attached together, as would be appreciated by one with skill in the art. The second connector 40 includes a rod receiving passageway 41, top surface 46, a plurality of support connectors 42, an outer wall 44, a plurality of support elements 45, and a bottom surface 49.

The rod receiving passageway 41 has an outer ring 41*a* and an inner ring 41*b*, which define an opening 48 extending through the second connector 40. As shown, the inner ring 41*b* is disposed within the outer ring 41*a* and covers only part of the inner surface of the outer ring 41*a*, thus forming an flange that is the thickness of the inner ring 41*b*.

The top surface 46 is a planar surface extending from the rod receiving passageway 41. In the shown embodiment, the top surface 46 is a curved shape, but one skilled in the art should appreciate that other designs are possible as long as such design and shape would permit modular assembly and connection.

In the shown embodiment, the support connectors 42 extend away from the second connector 40, at angles with respect to the top surface 46. Each support connector 42 is positioned along an outer circumference thereof, along one side of the second connector 40 and separated from the rod receiving passageway 41 and the opening 48. Each support connector 42 optionally includes a flange disposed on the outside of the protrusions 43. The second connector 40 can be a range of possible shapes, and consequently, the support connectors 42 can be positioned at any location on the shape, as appreciated by one with skill in the art. Furthermore, although the embodiment of FIGS. 7-9 shows two protrusions 43, the support connectors 42 can be of any number required for the display system application. The support connectors 42 can be either solid or hollow.

The outer wall 44 extends along the circumference of the second connector 40 between the outer ring 41*a* and the protrusions 43. The outer wall 44 can be of any height that provides sufficient rigidity to the second connector 40.

Support elements 45 extend between the outer edges of the outer ring 41*a* and the protrusions 43. The support element 45 is a buttress type support in the shown embodiment. However, the support element 45 can be of any number and size that provides sufficient rigidity to the second connector 40.

Figure 7:
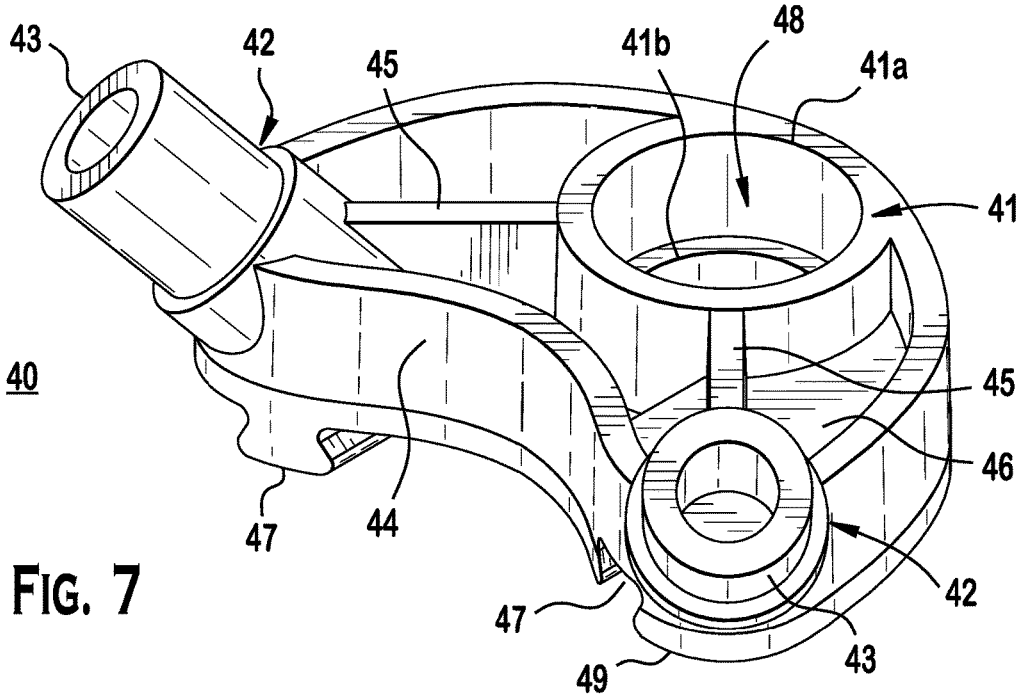
FIG. 7 is a top perspective view of a second connector of a modular display system according to the invention.
Figure 8:
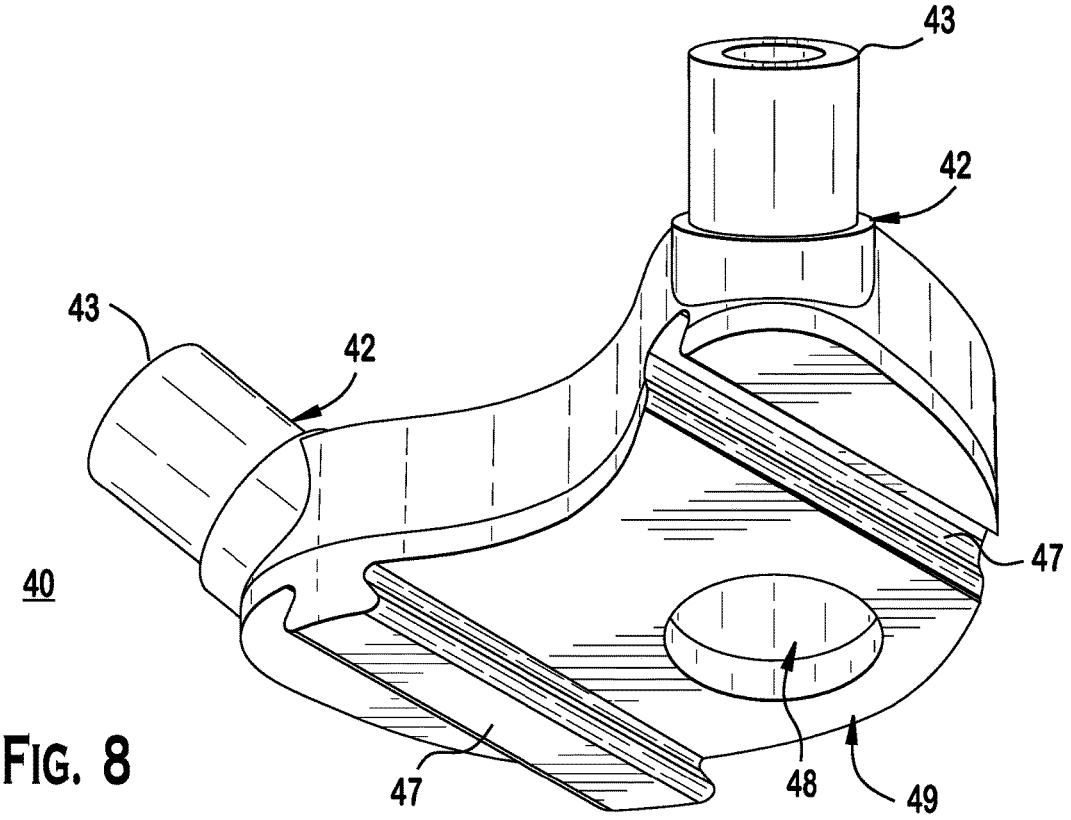
FIG. 8 is a bottom perspective view of the second connector of FIG. 7.
Figure 9:
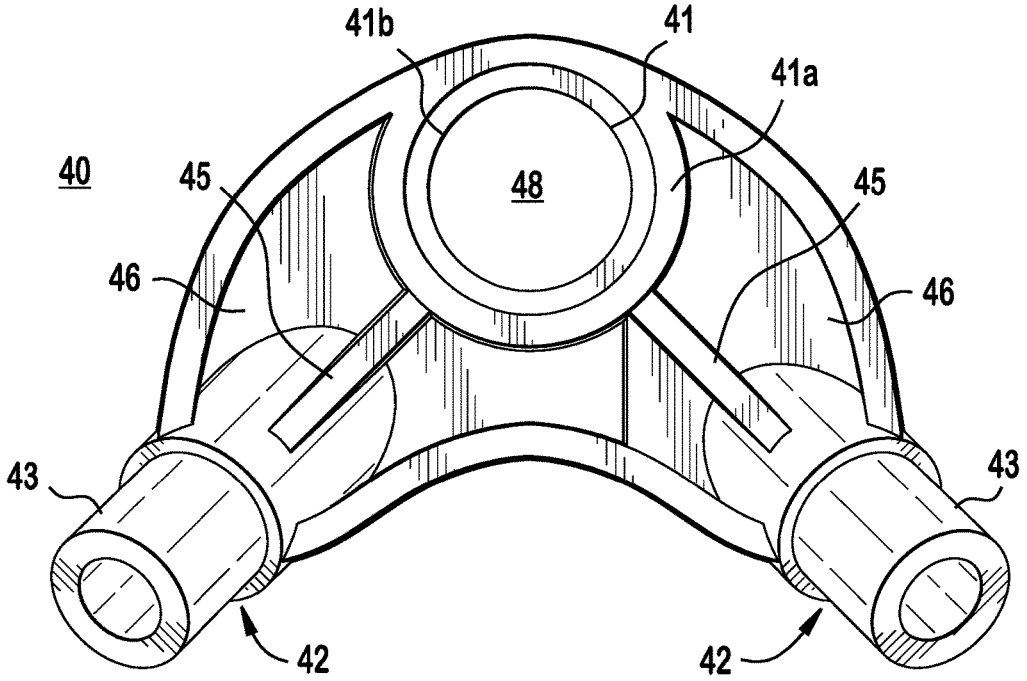
FIG. 9 is a top view of the second connector of FIG. 7.

The bottom surface 49 of the second connector 40 includes mating connectors 47, as best shown in FIGS. 7 and 8. In the shown embodiments of FIGS. 7 and 8, the mating connectors 47 are a pair of dovetail mating connectors. However, the mating connectors 47 could be any structure or material that forms a connection removable connection, as well as an adhesive, fastener, or other attachment means known to those with skill in the art. Further, in the embodiment of FIGS. 7-9, the bottom surface 49 is flush with the bottom of the inner ring 41*b*, as best shown in FIGS. 7 and 8. One with skill in the art would appreciate that the inner ring 41*b* could be positioned at a range of locations along the inner surface of the outer ring 41*a*.

Figure 10:
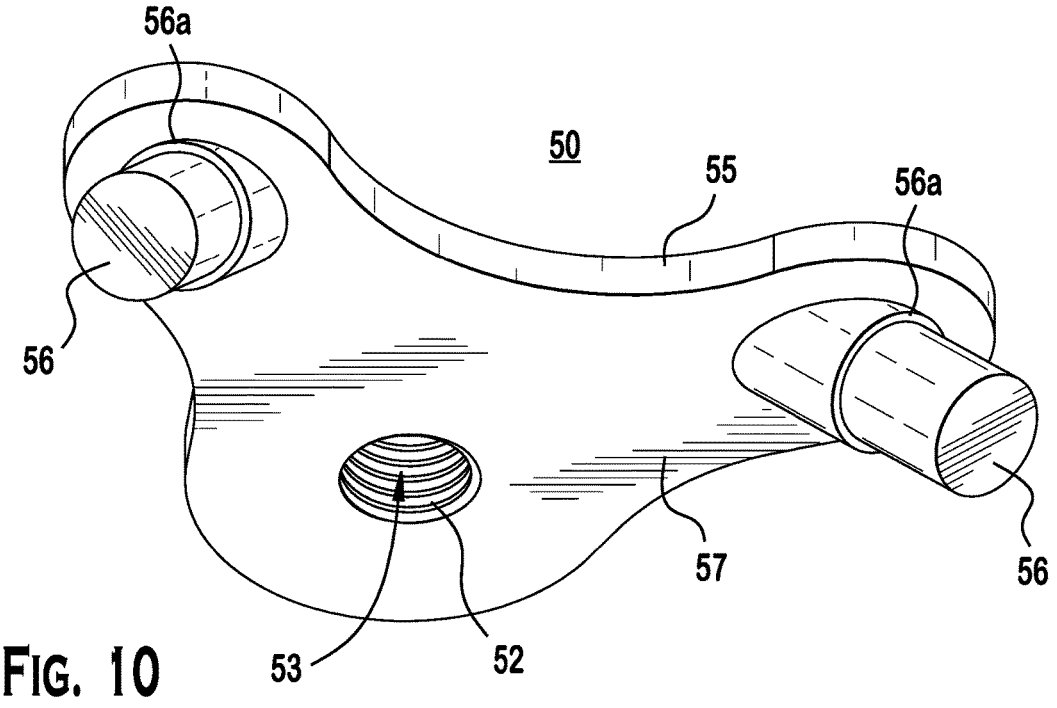
FIG. 10 is a bottom perspective view of a third connector of a modular display system according to the invention.
Figure 11:
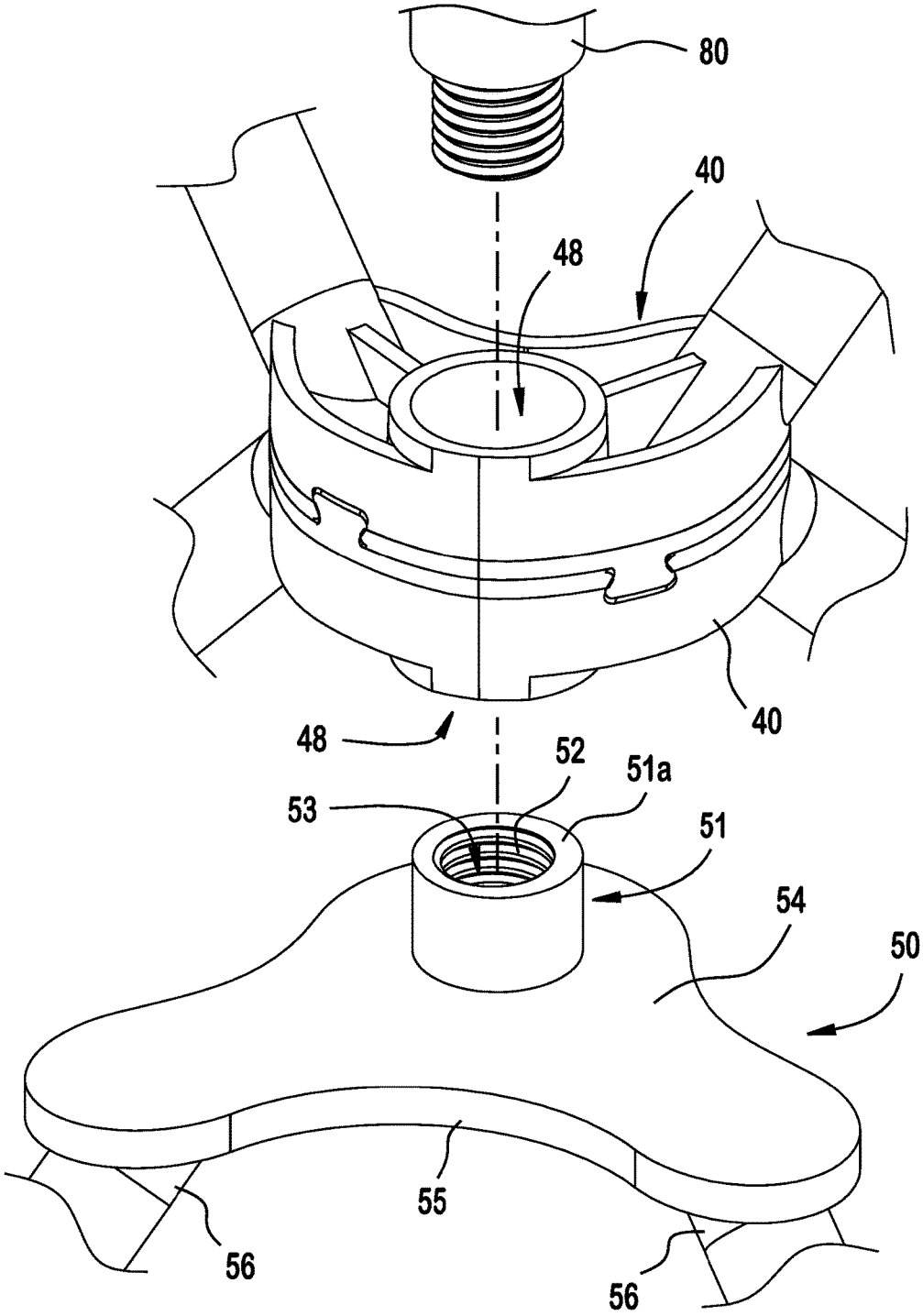
FIG. 11 is an exploded view of a plurality of second connectors and a third connector of a modular display system according to the invention.

Now with reference to FIGS. 10 and 11, the third connector 50 will be described. Referring to FIGS. 10 and 11, the third connector 50 includes a top surface 54, a bottom surface 57, an edge 55, a mating connector 51, and protrusions 56. The third connector 50 can be formed integrally and is shown as a plastic article, but could be prepared from other known materials available to one skilled in the art, including metals, fibrous material, or composites. The third connector 50 could also be formed as individual pieces which are then attached together, as would be appreciated by one with skill in the art.

The top surface 54 is a planar body. In the shown embodiment, the top surface 54 is a curved shape, but one skilled in the art should appreciate that other designs are possible as long as such design and shape would permit modular assembly and connection. The bottom surface 57 is the side of the planar body opposite the top surface 54. An edge 55 extends between the top surface 54 and bottom surface 57 in a direction orthogonal to the surfaces 54, 57. The edge 55 can be of any thickness that provides sufficient rigidity to the third connector 50.

The mating connector 51, shown best in FIG. 11, is a protrusion extending from the top surface 54. The mating connector 51 includes a mating inner surface 52, which defines a receiving passageway 53 extending through the third connector 50. The mating connector 51 is shown in the embodiment of FIGS. 10 and 11 as a threaded connection, but one with skill in the art would appreciate that other mating connections could be used.

The protrusions 56, best shown in FIG. 10, extend away from the third connector 50 at angles with respect to the bottom surface 57. The protrusions 56 are positioned near the outer circumference, along one side of the third connector 50 and apart from the mating connector 51 and the receiving passageway 53. The protrusions can be solid or hollow, and optionally include an abutment flange disposed on the outside of the protrusion 56. The protrusions 56 can be positioned at any location on the shape of third connector 50, as should be appreciated by one with skill in the art. Furthermore, although the embodiment of FIGS. 10 and 11 shows two protrusions 56, the protrusions 56 can be of any number required for the display system application.

Now with reference to FIG. 12, an end member 60 will be described. The end member 60 includes a handle 61, a ring surface 62, and a connector 63.

Figure 12:
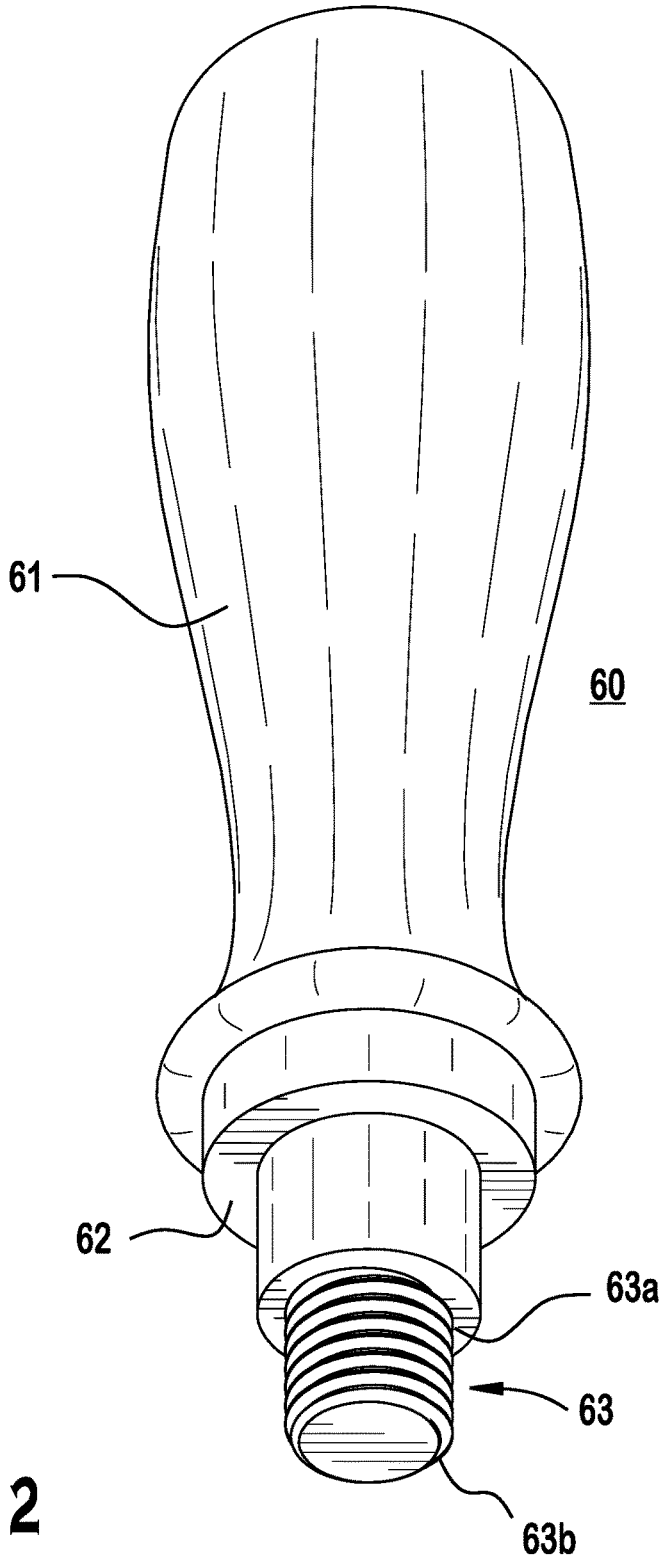
FIG. 12 is a perspective view of an end member of a modular display system according to the invention.

The embodiment of FIG. 12 shows the handle 61 as a sculpted shape, but one with skill in the art should appreciate that the handle 61 could be any of a range of shapes. The ring surface 62 extends from the distal end of the handle 61. The connector 63 extends from the ring surface 62, and has a connecting end 63*b* along with an annular surface 63*a*. FIG. 12 shows the connecting end 63*b* as a threaded male connector, but one with skill in the art would appreciate that the connector 63 could be either a male or female connector, and could be other mating connections alternatively to the threaded connection.

The end member 60 can be formed integrally and in an exemplary embodiment is a plastic handle 61 with an aluminum ring surface 62 and connector 63. However, any element of the end member 60 could be prepared from other known materials available to one skilled in the art, including metals, fibrous material, or composites. The end member 60 could also be formed as individual pieces which are then attached together, as would be appreciated by one with skill in the art.

Figure 13:
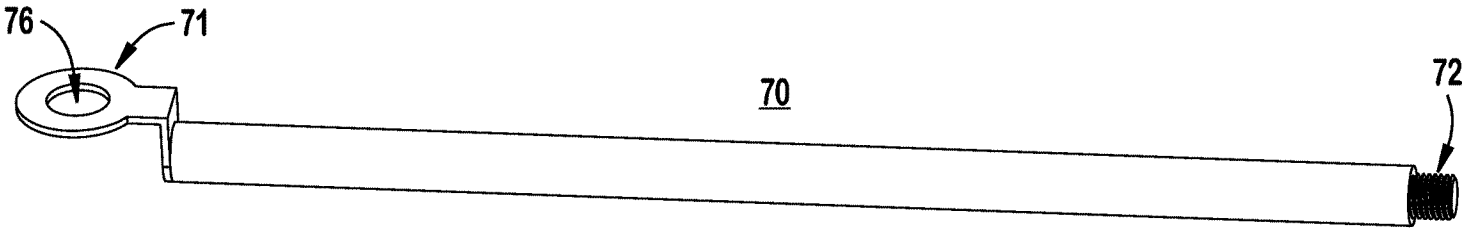
FIG. 13 is a side view of a second rod of a modular display system according to the invention.
Figure 14:
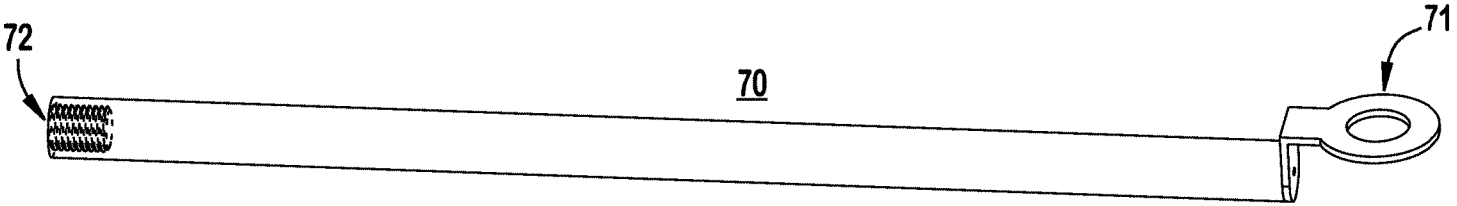
FIG. 14 is a side view of a second rod of a modular display system according to the invention.

Now with reference to FIGS. 13 and 14, a second rod 70 will be described. The second rod 70 includes an elongated body with an end loop 71 positioned at a proximal end and a mating connector 72 positioned at a distal end. In the shown embodiment, the elongated body of the second rod 70 is cylindrical, but one skilled in the art should appreciate that other designs are possible as long as such design and shape would permit modular assembly and connection. The end loop 71 defines a receiving passageway 71*a*. The mating connector 72 may be either a male connector, shown in FIG. 13, or a female connector, shown in FIG. 14. In the shown embodiment, the mating connector 72 is a threaded connector, but one skilled in the art should appreciate that the connector could be other mating connections alternatively to the threaded connection.

Figure 15:
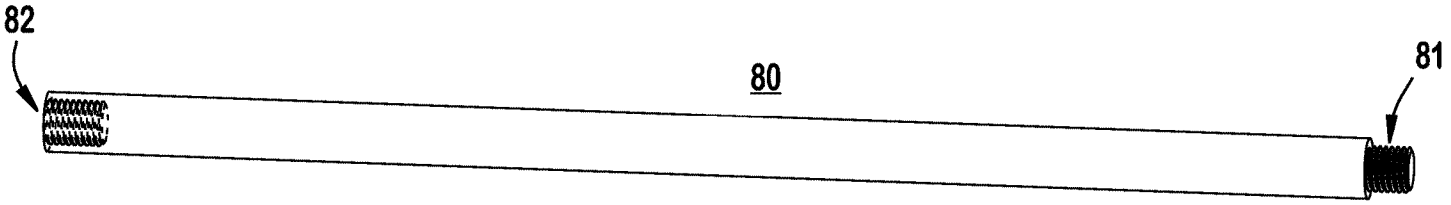
FIG. 15 is a side view of a third rod of a modular display system according to the invention.

Now with reference to FIG. 15, a third rod 80 will be described. The third rod 80 includes an elongated body with a first mating connector 81 positioned at a proximal end, and a second mating connector 82 positioned at a distal end. In the shown embodiment, the third rod 80 is cylindrical shaped, but one skilled in the art should appreciate that other designs are possible as long as such design and shape would permit modular assembly and connection. The first mating connector 81 is a male connector, while the second mating connector 82 is a female connector. In the shown embodiment, the mating connectors 81, 82 are threaded connectors, but one skilled in the art should appreciate that the connector could be other mating connections alternatively to the threaded connection.

Now with reference to FIGS. 2 and 16, a base 90 will be described. As shown, the base 90 includes a base body 91, a plurality of fastener receiving passageways 92, and a grip 93.

The base body 91 is a planar object made from a solid structural material, such as a metal such as aluminum. However, one skilled in the art would appreciate that the base body 91 may be prepared from other structural materials such as fibrous material, plastic, or material composite, and include various polygonal shapes. Further, one skilled in the art would appreciate that the base body 91 may be hollow. The base body 91 includes a major planar surface that is a support surface.

The fastener receiving passageways 92 are openings or passageways extending through the base body 91. The fastener receiving passageway 92 may extend completely through the base body 91, or may be a blind receiving passageway that only partially extends through the base body 91.

Figure 16:
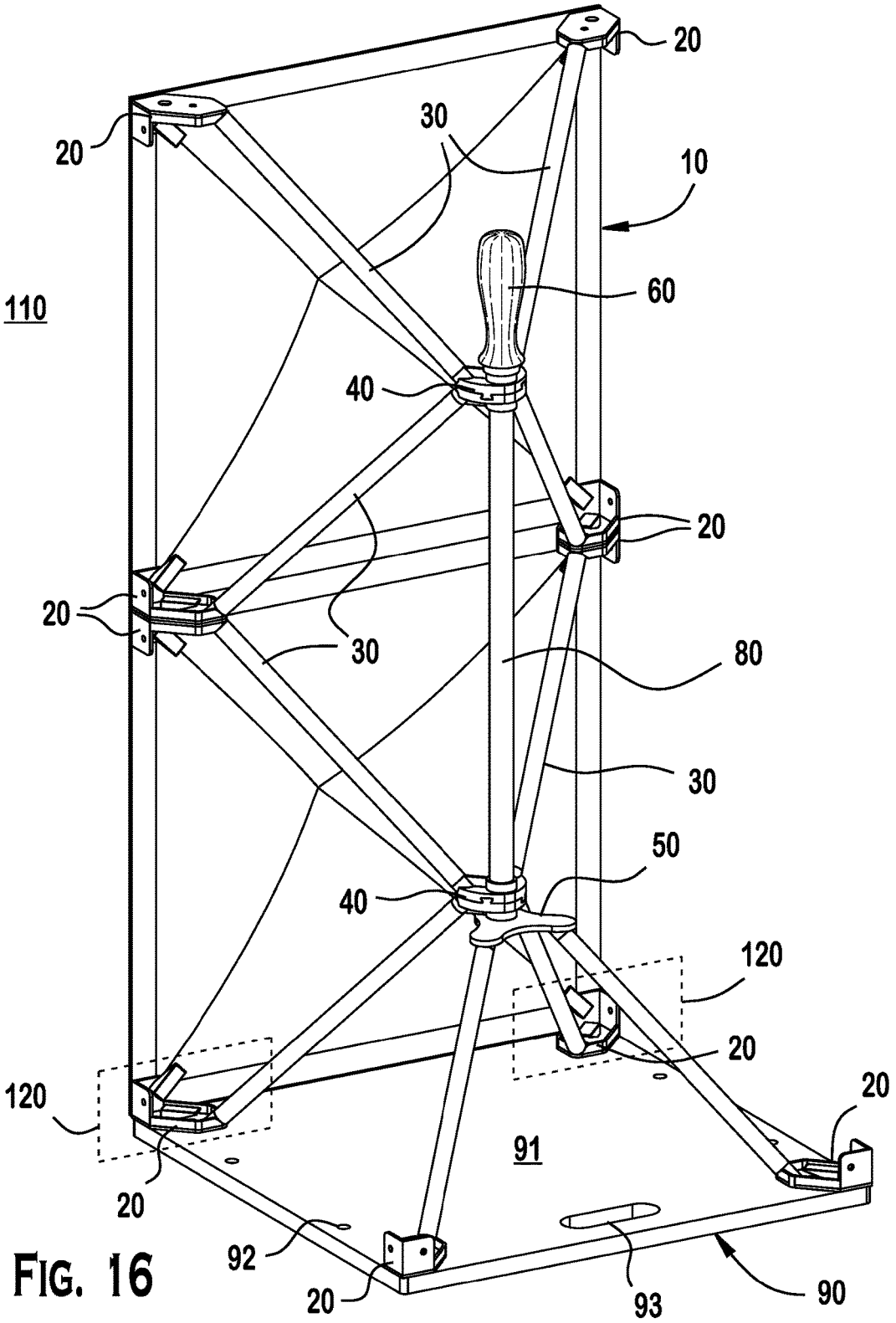
FIG. 16 is an enlarged perspective view of the modular display system of FIG. 2.

As shown in FIG. 16, the grip 93 is an oval shaped opening positioned along a side of the base body 91. The grip 93 may be integral to the base 90 or a separate component that attaches to the base 90. For instance, in other embodiments, the grip 93 may be an abrasive material, a coating, or resistive pattern disposed along a surface of the base body 91, such as grooved patterns or sand paper material. Additionally, one skilled in the art would appreciate that connecting articles may be used, including a handle, a knob, or other gripping members.

Now with reference to FIGS. 6, 18, and 19, the fasteners 100 will be described. Each fastener 100 is a swell latch including a lever 102, a screw 104, a washer 106, and a nut 108. The lever 102 is connected to a proximal end of the screw 104. The washer 106 is an annular element extending around the circumference of the screw 104. In the shown embodiment the washer 106 is formed of rubber, but one with skill in the art should appreciate that the washer 106 could be formed of any elastically deformable material. The nut 108 is positioned on a distal end of the screw 104, and abuts the washer 106. The lever 102, screw 104, and nut 108 are formed of plastic in the shown embodiment, but one skilled in the art should appreciate that these elements could be formed of any material that permits the function of the swell latch and modular element fastening. Further, one skilled in the art should appreciate that the fastener 100, in other embodiments, may be any known type of fastener, such a latch, screw, nut and bolt, hook and loop fastener, and removable adhesive.

Now, with reference to the drawings, assembly of the modular display system 1 will be described.

As shown in FIG. 2, the first connectors 20 are attached to a rear of the modular panels 10, and are also attached to first connectors 20 of an adjacent modular panel 10. As shown in FIG. 2, first connectors 20 are positioned along each edge of the square modular panels 10, but the first connectors 20 can be oriented on the rear of the modular panels 10 in any number and configurations known to those skilled in the art that would permit modular assembly and connection.

Figure 17:
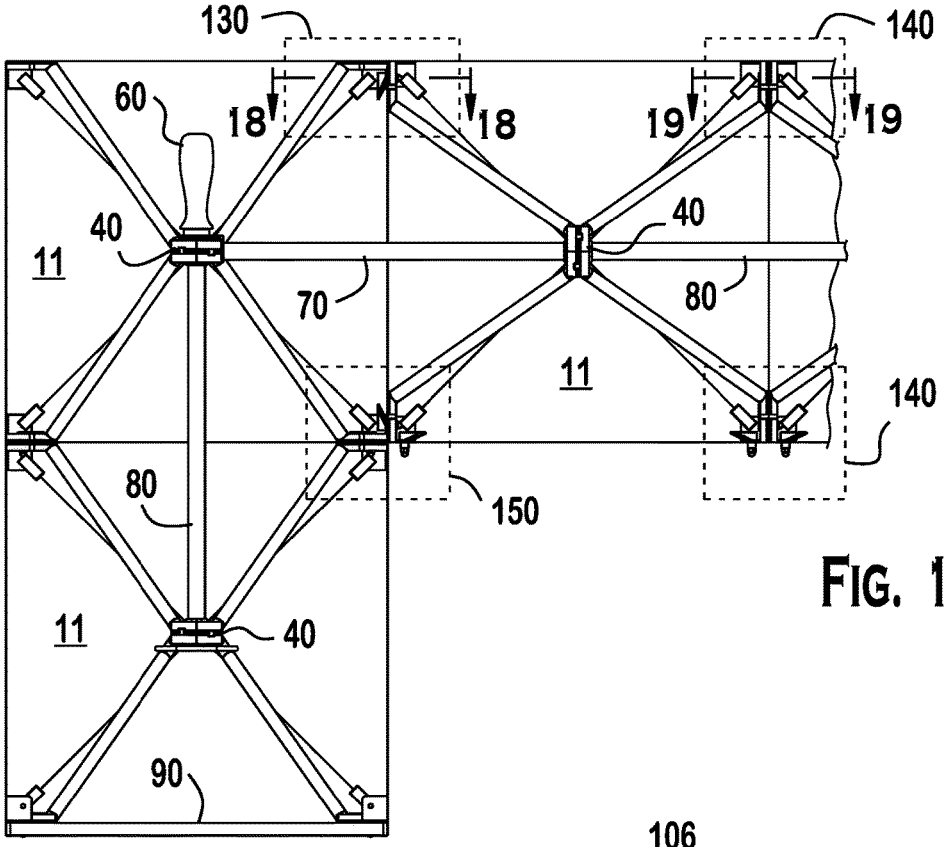
FIG. 17 is a rear view of the modular display system according to the invention.

The connection between a modular panel 10 and a first connector 20 is shown in greater detail in FIGS. 17-20. FIG. 17, in particular, outlines three types of connections 130, 140, and 150 between first connectors 20 and modular panels 10.

Figure 18:
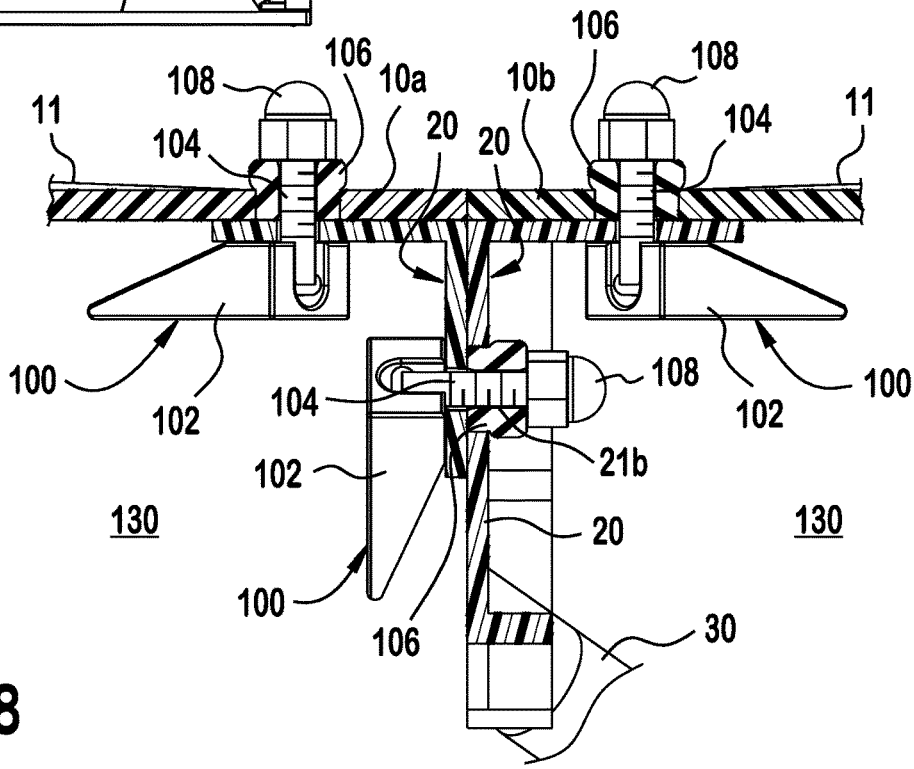
FIG. 18 is a sectional view of the modular display system of FIG. 17, taken along line 18-18.

As shown in FIG. 18, two first connectors 20 and fasteners 100 are connected to form the connection 130. As shown in FIG. 18, the left modular panel 10*a* abuts the right modular panel 10*b*. The first connector 20 positioned on the left abuts a modular panel 10*a*, and is positioned such that the support wall 24 contacts the rear of left modular panel 10*a*. A fastener 100 extends through both the fastener receiving passageway 22 in the support wall 24 and through fastener receiving passageway 16 in the modular panel 10*a*. The swell latch fastener 100 attaches first connector 20 to the modular panel 10*a*, and also connects display element 12 to the modular panel 10*a*.

The first connector 20 on the right abuts the rear of right modular panel 10*b*, and is positioned such that the support wall 24 contacts the rear of right modular panel 10*b*. A fastener 100 extends through both the fastener receiving passageway 22 in support wall 24 and through fastener receiving passageway 16 in the modular panel 10*b*. The swell latch fastener 100 attaches first connector 20 to modular panel 10*b*.

In addition to connecting each first connector 20 to the modular panels 10*a* and 10*b*, the connection 130 in FIG. 18 also depicts a connection between the two first connectors 20 to laterally connect the modular panels 10*a* and 10*b*. The support wall 24 of left modular panel 10*a* abuts the base 27 of right modular panel 10*b*. A fastener 100 extends through both the fastener receiving passageway 22 of support wall 24 and fastener receiving passageway 22 of base 27 of right modular panel 10*b*, attaching the left modular panel 10*a* to the right modular panel 10*b*.

The fasteners 100 in the embodiment of FIG. 18 extend through the aligned fastener receiving passageways with the lever on a particular side. However, one with skill in the art would appreciate that the fasteners could extend through the aligned fastener receiving passageways and attach two abutting elements independent of the side on which the lever is disposed.

The connection 140 of FIG. 17 will now be described. As shown in FIG. 19, two first connectors 20 along with fasteners 100 used to form the connection 140 of FIG. 17. As shown in FIG. 19, the left modular panel 10*c* abuts the right modular panel 10*d*. Left first connector 20 abuts left modular panel 10*c*, and is positioned such that support wall 24 contacts the rear of left modular panel 10*c*. A fastener 100-4 extends through both the fastener receiving passageway 22 in support wall 24 and through fastener receiving passageway 16 in modular panel 10*c*. The swell latch fastener 100-4 attaches first connector 20 to modular panel 10*c*.

Right first connector 20 abuts the rear of right modular panel 10*d*, and is positioned such that the support wall 24 contacts the rear of right modular panel 10*d*. A fastener 100 extends through both the fastener receiving passageway 22 in support wall 24 and through fastener receiving passageway 16 in the modular panel 10*d*. The swell latch fastener 100-5 attaches first connector 20 to modular panel 10*d*.

Figure 19:
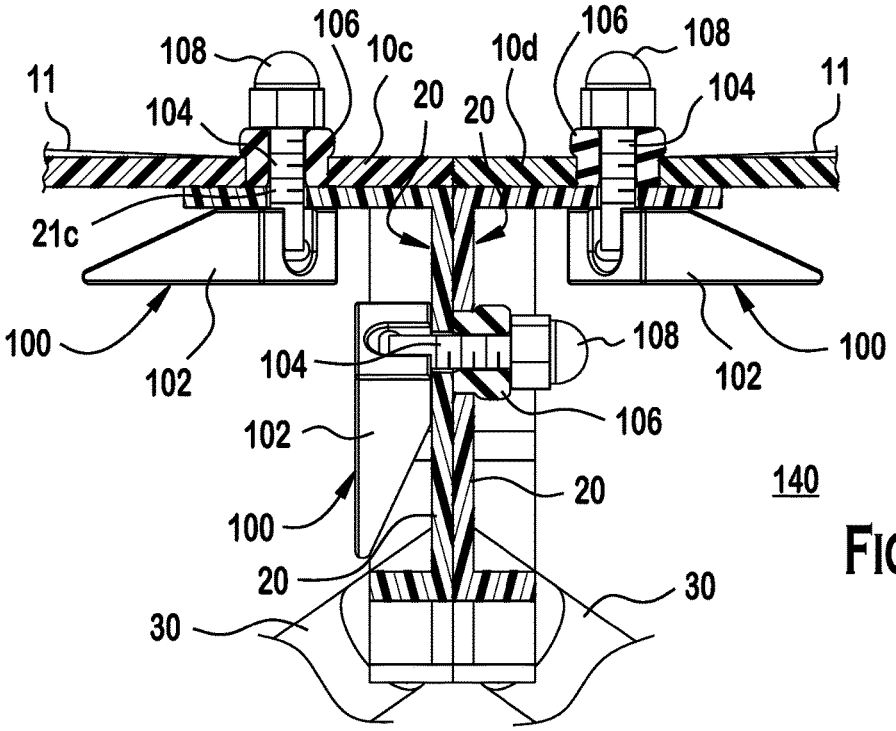
FIG. 19 is a sectional view of the modular display system of FIG. 17, taken along line 19-19.

In addition to connecting each first connector 20 to modular panels 10*c* and 10*d*, the connection 140 in FIG. 19 also depicts a connection between the two first connectors 20 and 20 to laterally connect the modular panels 10*c* and 10*d*. The base 27 of left modular panel 10*c* abuts the base 27 of right modular panel 10*d*. The fastener 100 extends through both the fastener receiving passageway 22 of base 27 and fastener receiving passageway 22 of base 27, attaching left modular panel 10*c* to right modular panel 10*d*.

Figure 21:
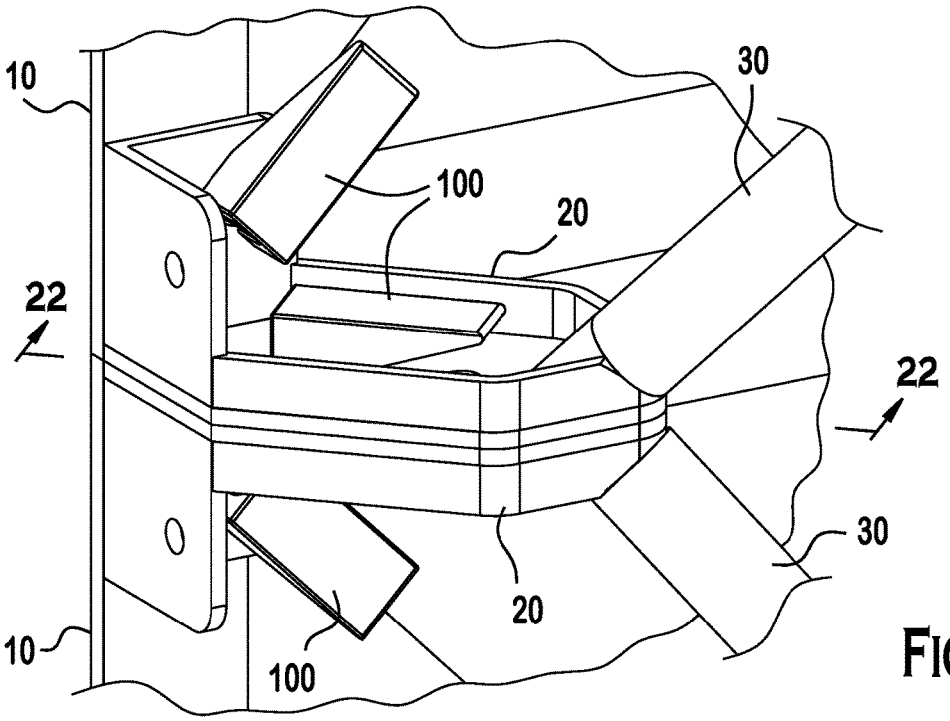
FIG. 21 is a perspective view of a pair of first connectors of the modular display system according to the invention.
Figure 22:
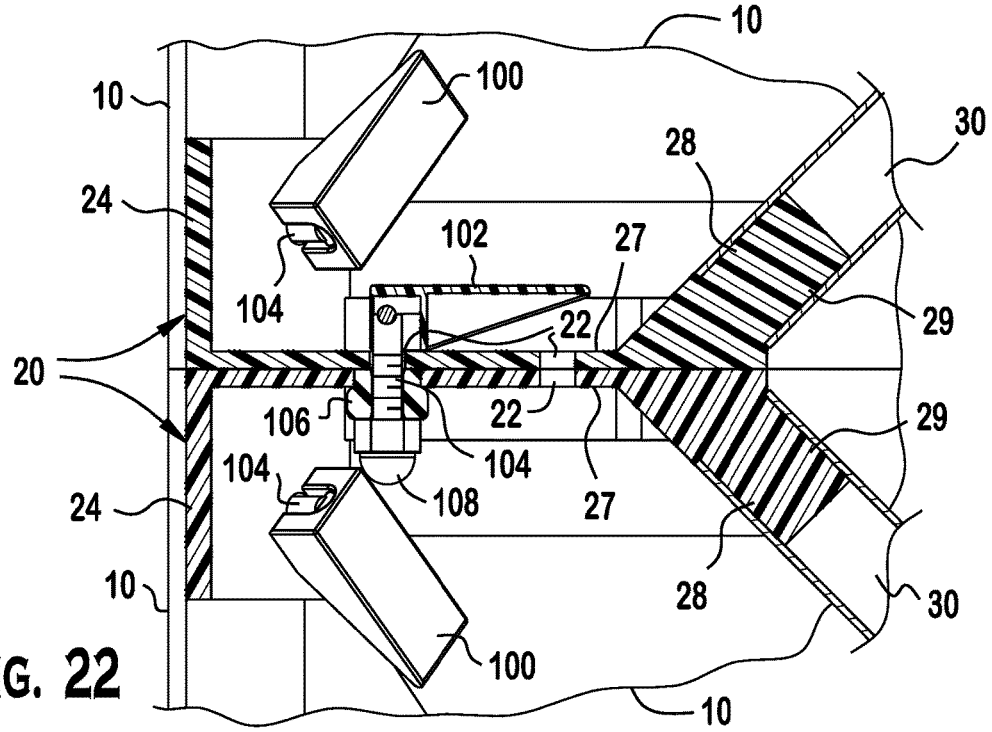
FIG. 22 is sectional view of the plurality of first connectors of the modular display system of FIG. 21, taken along line 22-22.

The connection 140 is also shown in FIGS. 21 and 22; the connection embodiment depicted in FIGS. 21 and 22 vertically connects modular panels, while the connection embodiment depicted in FIG. 19 laterally connects modular panels.

The fasteners 100 in FIG. 19 extend through the aligned fastener receiving passageways with the lever on a particular side. However, one with skill in the art would appreciate that the fasteners could extend through the aligned fastener receiving passageways and attach two abutting elements independent of the side on which the lever is disposed.

Figure 20:
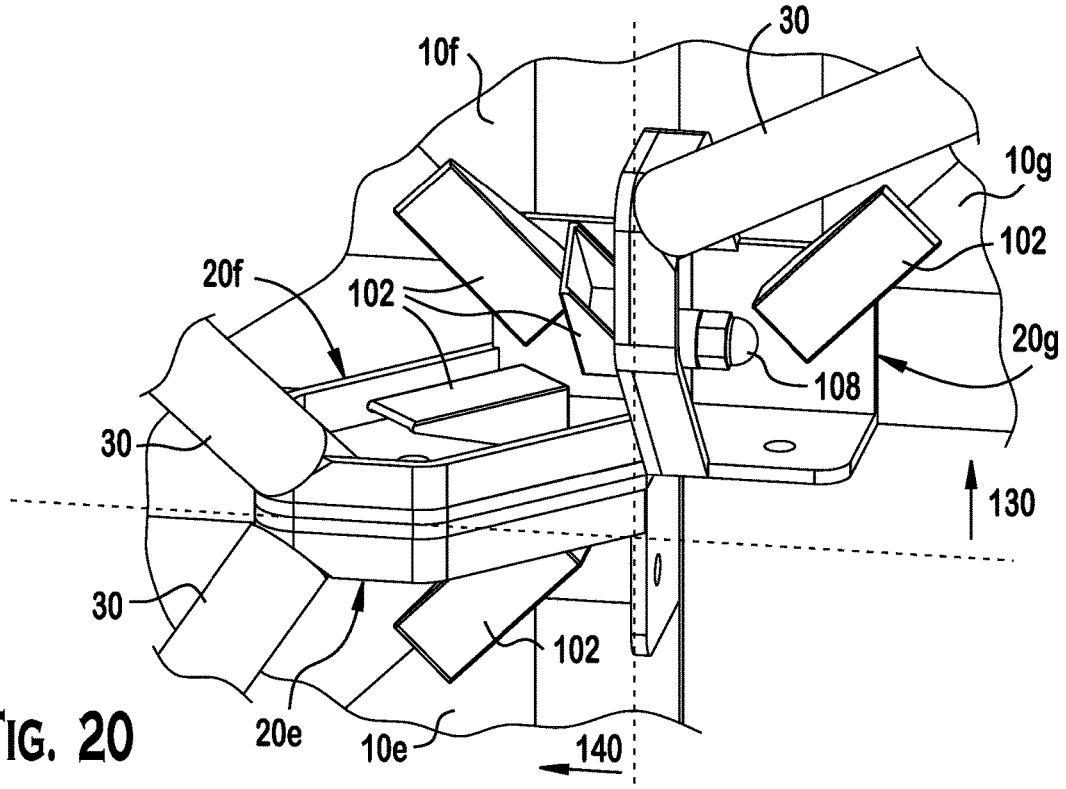
FIG. 20 is a close up perspective view of a plurality of first connectors of the modular display system of FIG. 17.

The connection 150 of FIG. 17 will now be described. As shown in FIG. 20, connections between modular panels 10 using first connectors 20 in the modular display system 1 can be formed from aforementioned connections 130 in FIG. 18 and 140 in FIG. 19. The two modular panels 10*e* and 10*f* in FIG. 20 are two vertically connected panels. Modular panels 10*e* and 10*f* are each connected to first connectors 20, respectively, and first connectors 20 are connected to one another in the same manner as connection 140 described with reference to FIG. 19; the fastener 100 connects the two modular panels 10 through fastener receiving passageways in their respective bases.

The modular panel 10*g* in FIG. 20 is a modular panel that extends laterally from modular panel 10*f*, and connects to the modular panel 10*f* in the same manner as connection 130 described above with reference to FIG. 18; the fastener 100 connects the two modular panels 10*g* and 10*f* through an alignment of a fastener receiving passageway in the base of first connector 20 and a fastener receiving passageway in a wall of first connector 20. The connection 150 thus shows a connection of two vertically connected modular panels 10 to a one laterally connected modular panel 10.

The first connectors 20 connecting the base body 91 and a modular panel 10 will now be described with reference to FIGS. 6 and 16. This connection is outlined in box 120 in FIG. 16, depicting the connection of the first connectors 20 at the proximal end of the base body 91. As shown in FIG. 6, the first connector 20 is attached to the base body 91 via fastener 100 extending through fastener receiving passageway 22 in the base 27 and aligned fastener receiving passageway 92 in the base body 91. The first connector 20 is attached to the modular panel 10 via fastener 100 extending through the fastener receiving passageway 22 in the support wall 24, and through an aligned fastener receiving passageway 16 (not shown) in the modular panel 10.

As shown in FIG. 16, the first connectors 20 at the distal end of the base body 91 are not also connected to a modular panel 10. These first connectors 20 are attached to the base body 91 via fastener 100 extending through fastener receiving passageway 22 in the base 27 and aligned fastener receiving passageway 92 in the base body 91.

The connection of the first rods 30 will now be described with reference to FIGS. 2 and 6. As shown in FIG. 6, the protrusion 29+of the first connector 20 forms a mating connection with a proximal end 32 of the first rod 30, such that the first rod 30 is attached to the first connector 20 and extends away from the first connector 20 at the angle of the protrusion 29. A fastener, such as a screw 104, is optionally used to secure the mating connection between the protrusion 29 and the first rod 30. As shown in FIG. 2, a first rod 30 extends from the protrusion 29 of each first connector 20.

The distal end 34 of a first rod 30 is connected to a second connector 40 as shown in FIGS. 2 and 14-17. The distal end 34 forms a mating connection with the support connectors 42 of a second connector 40. In the embodiment shown in FIG. 23, the first rods 30 fit over the support connectors 42 and abut the abutment flange, but the first rods 30 could also fit inside the protrusions 43, as should be appreciated by those with skill in the art. The mating connection between the first rods 30 and the support connectors 42 can optionally be secured by a screw or other fastening element (not shown).

Figure 23:
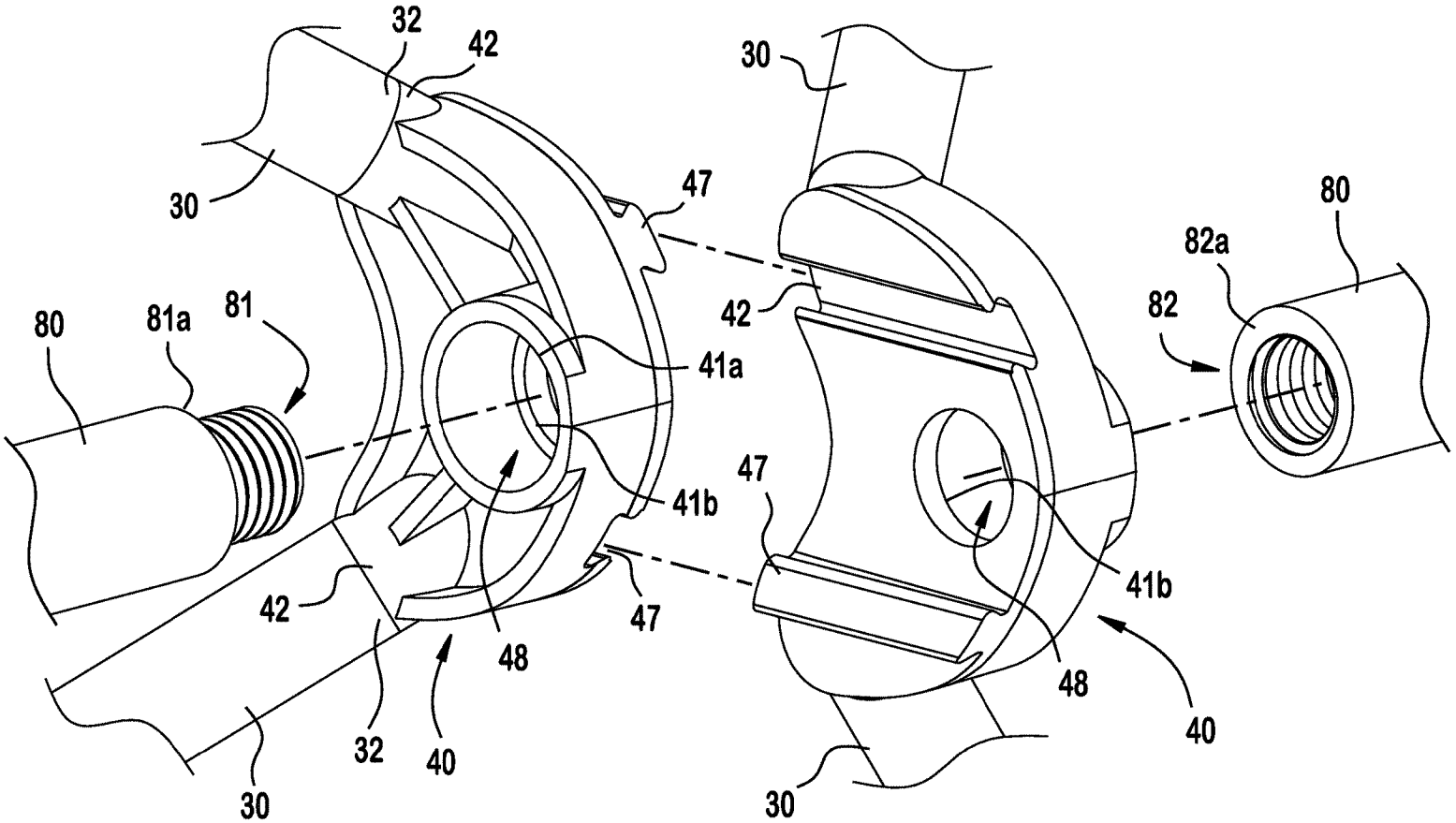
FIG. 23 is an exploded perspective view of a plurality of second connectors of a modular display system according to the invention.
Figure 24:
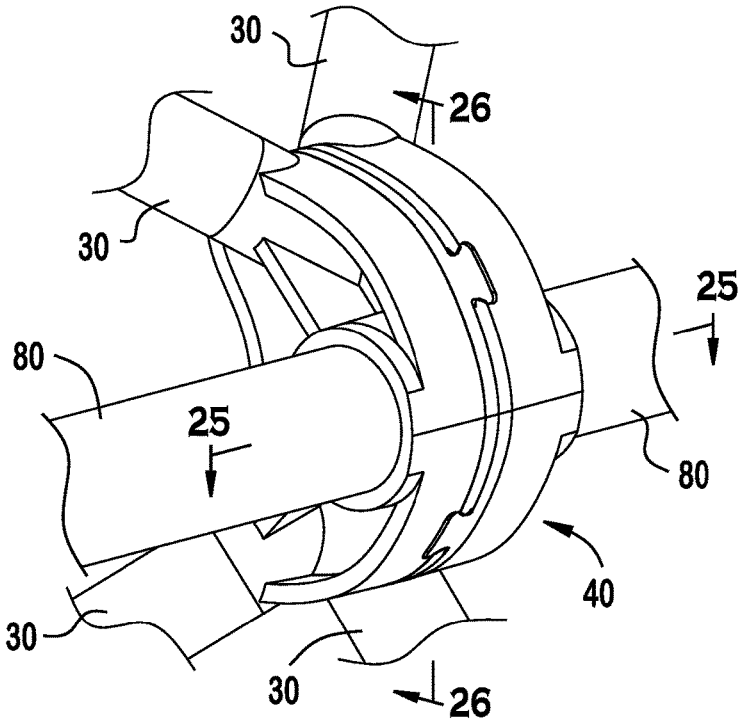
FIG. 24 is another perspective view of a plurality of second connectors according to the invention.

Two second connectors 40 are connected via mating connectors 47, as shown in FIGS. 23 and 24. Further, a third rod 80 connects to another third rod 80 through the mated second connectors 40. As shown in FIG. 23, the ends of the third rods 80 extend into the openings 48 of each second connector 40. A surface 81*a* of the male end 81 abuts the abutment flange of one second connector 40, while a surface 82*a* of the female end 82 abuts the abutment flange of the mating second connector 40. The male end 81 of third rods 80 matingly connects with the female end 82 of other rod 80 through the opening 48 that extends through the second connectors 40. The connection of both second connectors 40 and the connection of the rods 30 and 80 to the second connector 40 is shown in FIG. 24.

Figure 25:
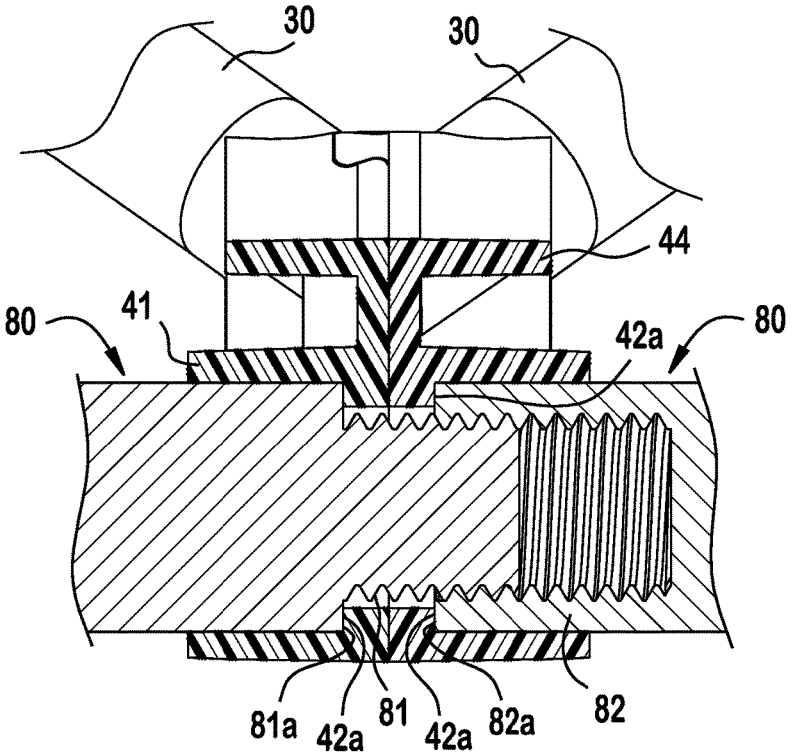
FIG. 25 is a sectional view of the plurality of second connectors of FIG. 24, taken along line 25-25.

FIGS. 25 and 26 are sectional views of the assembled second connector 40 and third rods 80 connecting through the second connector 40. FIG. 25 shows the two third rods 80 matingly connected, with surface 81*a* of male end 81 abutting the abutment flange, and surface 82*a* of the female end 82 abutting the abutment flange. FIG. 26 shows a section of the assembled second connector 40 including a section of the connection of the third rods 80 also depicted in FIG. 25 along with the connection of the mating connectors 47 of second connector halves.

The first rods 30 also form mating connections with the protrusions 56 of the third connector 50, as shown in FIGS. 11 and 27-29. In the embodiment shown best in FIG. 27, the first rods 30 fit over the protrusions 56 and abut the flange, but the first rods 30 could also fit inside the protrusions 56, as would be appreciated by those with skill in the art. The mating connection between the first rods 30 and the protrusions 56 can optionally be secured by a screw or other fastening element (not shown).

The third connector 50 is also connected to the second connector 40, as shown in FIG. 11. The mating connector 51 of the third connector 50 extends into the opening 48 of the second connector 40. Similarly to the third rods 80 described above with reference to FIG. 25, now referring to sectional view FIG. 28, the mating connector 51 extends into opening 48 within outer ring 41*a* of the second connector 40, and surface 51*a* abuts the inner ring flange. The mating connector 51 is positioned within the opening 48 such that the outer ring 41*a* also abuts the top surface 54 of the third connector 50.

Figure 28:
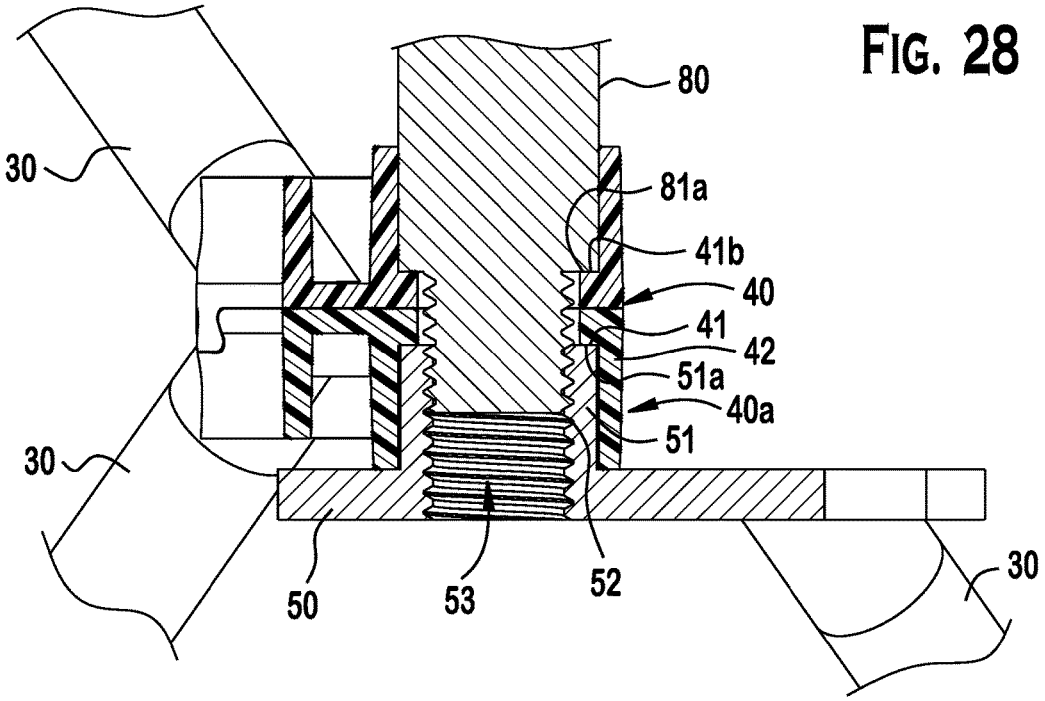
FIG. 28 is a sectional view of a plurality of second connectors and a third connector of a modular display system according to the invention.
Figure 29:
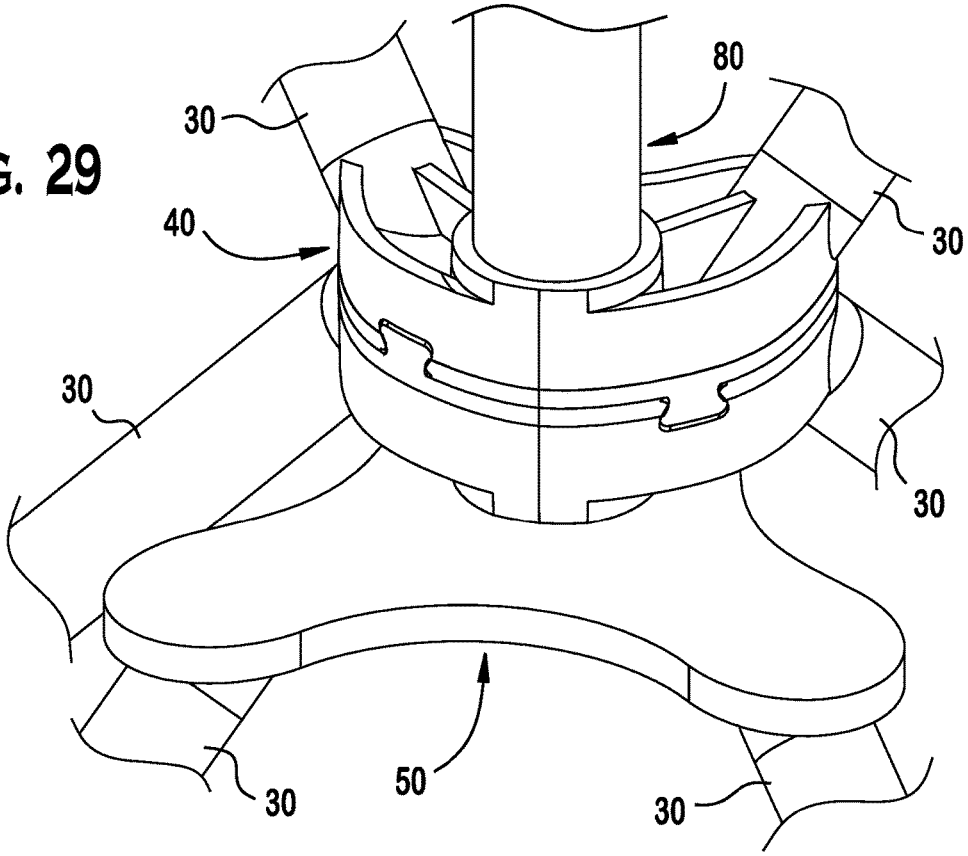
FIG. 29 is a perspective view of a plurality of second connectors and a third connector of a modular display system according to the invention.

The corresponding mating end of a third rods 80 extends into the other end of opening 48, also abuts the flange, and connects with mating inner surface 52 of the third connector 50. The third rods 80 thus fastens second connector 40 to third connector 50, as shown fully fastened in FIGS. 28 and 29, the assembly also including the connection of the first rods 30 to both the second connector 40 and the third connector 50. The embodiment shown in FIGS. 11 and 28 shows the mating connector 51 of the third connector 50 as the female connector, and the mating end of the third rods 80 as the male connector, but one with skill in the art would appreciate that the mating male and female connectors could be disposed on either element.

A connection involving the end member 60 and the second rod 70 is depicted in FIGS. 12 and 30-35, and will now be described in greater detail.

Figure 30:
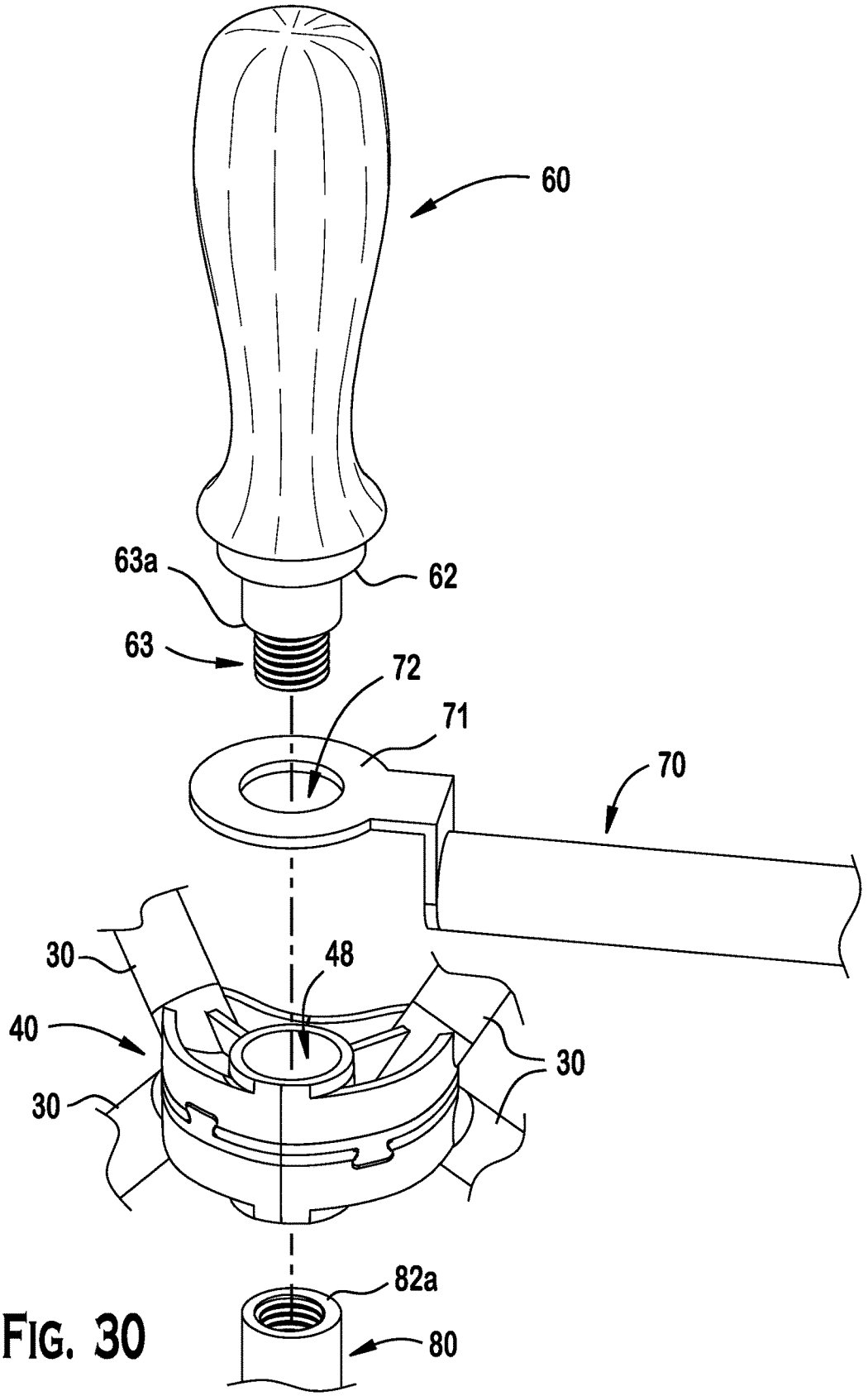
FIG. 30 is an exploded perspective view of an end member and a second connector of a modular display system according to the invention.

The end member 60 connects to a second connector 40, which also forms a connection with second rod 70, as shown in FIG. 30. Connector 63 extends down through receiving passageway 71*a* and into opening 48 of the second connector 40. Similarly to the other connections described above, as best shown in the sectional view of FIG. 31, the annular surface 63*a* abuts the flange, while the ring surface 62 abuts the end loop 71, which abuts the outer ring 41*a*. A mating third rod 80 extends up into opening 48, also abutting a flange, and connects with the connector 63.

Figure 32:
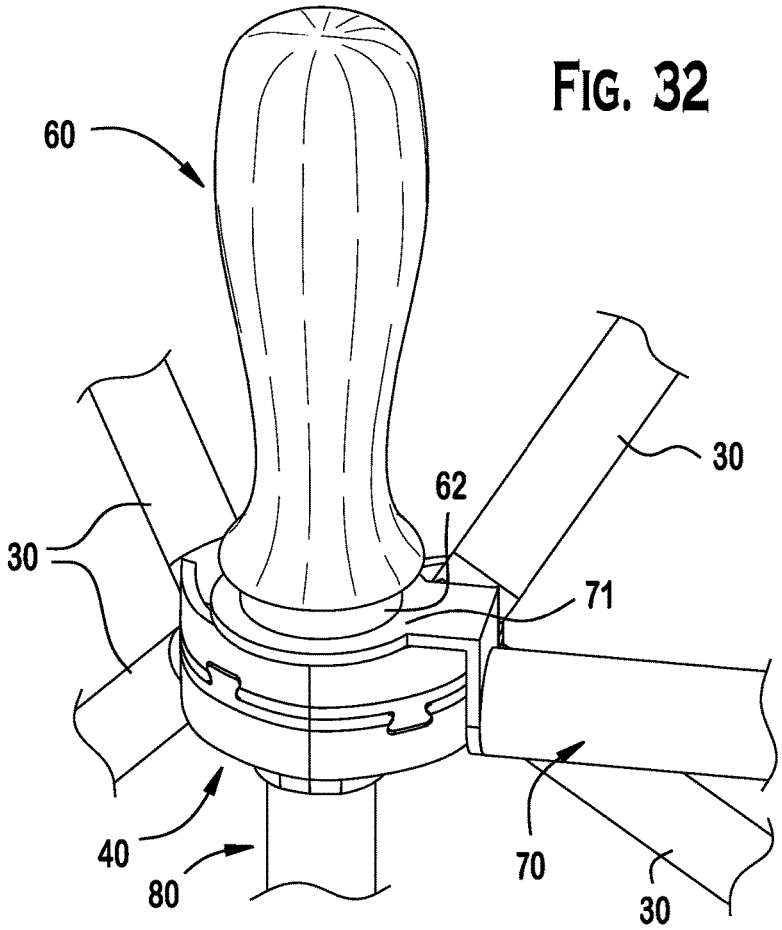
FIG. 32 is a perspective view of the end member and the second connector of FIG. 30, as assembled.
Figure 33:
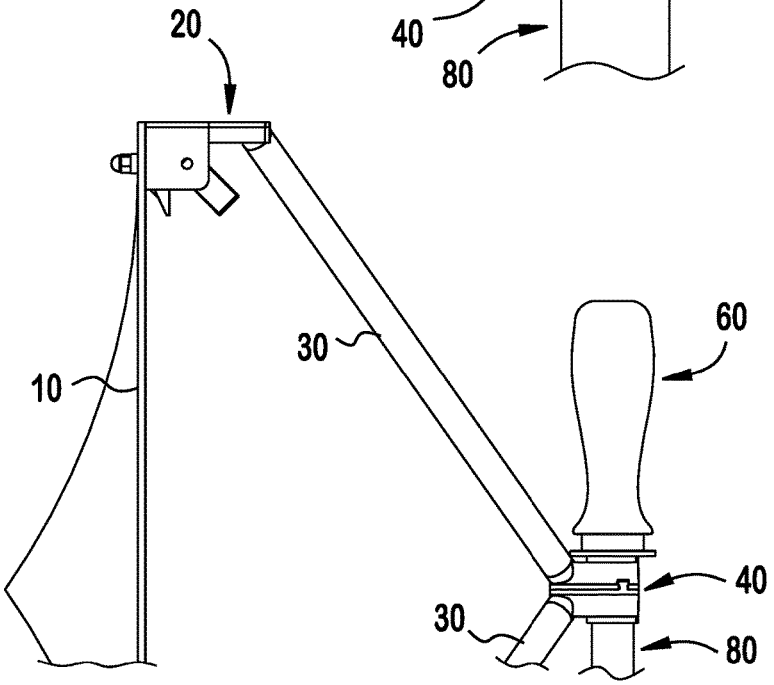
FIG. 33 is a side view of the end member and the second connector of FIG. 30.

The connection results in the assembly shown in FIG. 32, fastening the end member 60, the second rod 70, and the second connector 40, along with other rods 80 and 30 attached to the second connector 40. FIG. 33 shows the end member 60 and second connector 40 assembly connecting via the first rod 30 to first connector 20. The positioning and connections of the end member 60 and second connector 40 assembly within the modular display system 1 is also shown in FIGS. 2 and 16.

Figure 31:
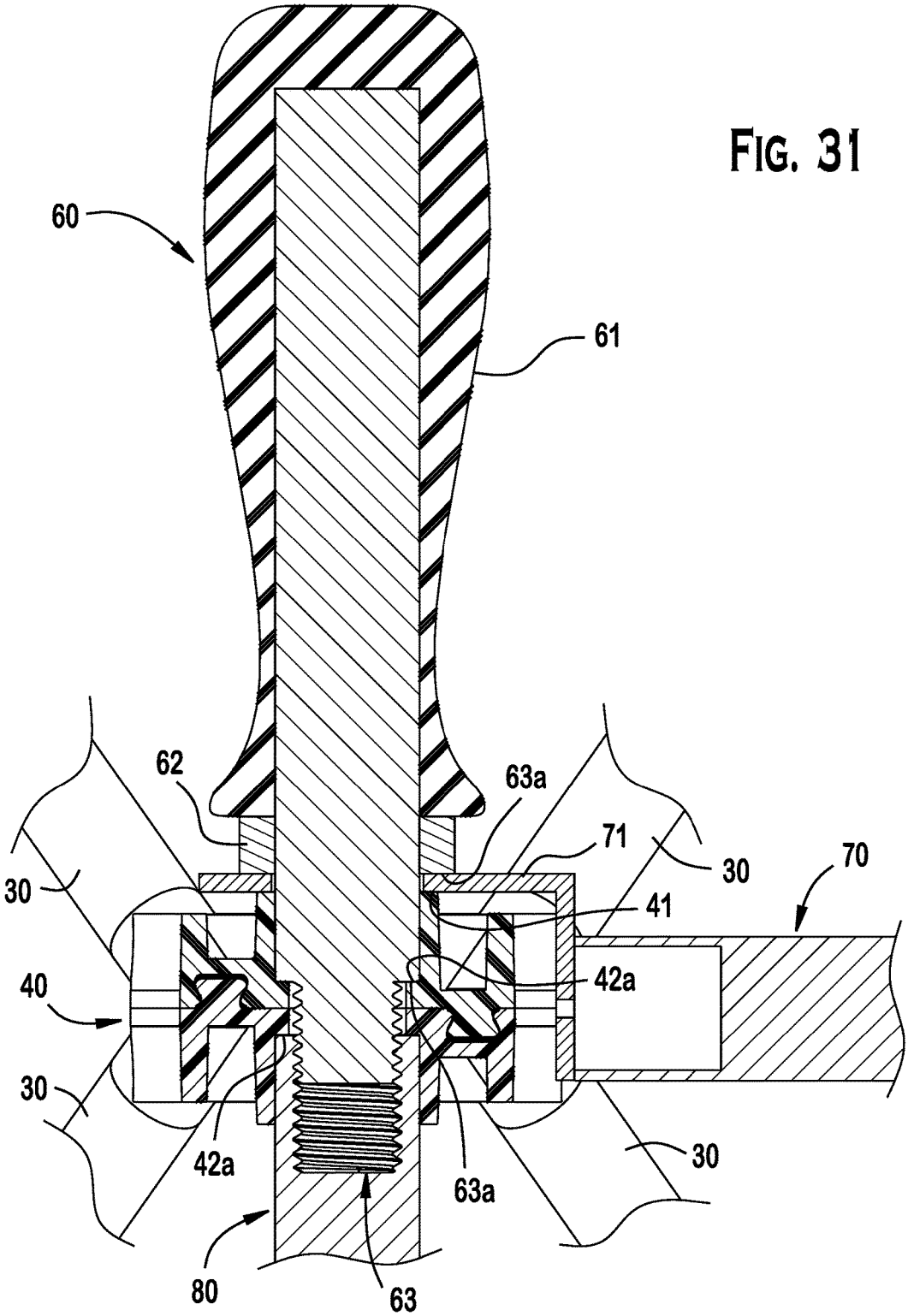
FIG. 31 is a sectional view of the end member and the second connector of FIG. 30, as assembled.

FIGS. 34 and 35 are similar to FIGS. 31 and 32 described above, however, FIGS. 34 and 35 show an alternative embodiment of the end member 60 and second connector 40 connection that omits the further connection to second rod 70. In this embodiment, the ring surface 62 directly abuts the outer ring 41*a* without the intervening end loop 71.

Now, with reference to FIGS. 1 and 2, a connection assembly for use of the display system 1 will be described. In general, as shown in FIG. 1, the display system 1 is assembled such that a plurality of modular panels 10 are displayed as a setting or background for a scene, event, or situation.

Generally, each modular panel 10 is attached to the same supporting structure. In the embodiment of FIGS. 1 and 2, first connectors 20 are connected to each corner of the rear of a modular panel 10. The first rods 30 attached to each first connector 20 extend to attach to one mated pair of second connectors 40 per modular panel 10. This assembly is the basic modular panel 10 plus structural support, or modular panel assembly 100 outlined in FIG. 2, used to create a wide variety of possible modular displays 1.

The construction of the modular display system 1 using the modular panel assembly 100 requires three additional considerations: the standard connection of two adjacent modular panel assemblies 100, the formation of a side support section 110 outlined in FIG. 2, and the connections used when adjacent modular panel assemblies 100 have second connectors 40 facing different directions. Each of these assembly considerations will now be addressed in order.

In the standard connection of two adjacent modular panel assemblies 100, both the first connectors 20 at the rear of the modular panels 10 and the second connectors 40 corresponding to each modular panel 10 are connected. For example, the user places another modular panel assembly 100 adjacent to the first modular panel assembly 100, such as vertically with respect to the first modular panel assembly 100 as shown in FIGS. 2 and 16. The adjacent first connectors 20 are connected with fasteners 100, as described above with reference to FIGS. 18 and 19, and the second connectors 40 are attached with the third rods 80, as described above with reference to FIG. 23. When the modular panel assemblies 100 are assembled vertically, as shown in FIGS. 2 and 16, the second connectors 40 are parallel to one another.

The side support section 110 of the display system 1 includes a plurality of modular panels 10 and a base 90. In the formation of the base 90 in the embodiment of FIGS. 1, 2, and 16, a user positions a base body 91, as shown in FIGS. 2 and 16, on a surface, such as a floor. The distance between the adjacent base bodies 91 shown in FIG. 2 will depend on the overall dimensions and shape of the display system 1, as designed for a particular purpose. The user positions a base 90 using the grip 93 shown in FIG. 16.

The display system 1 is assembled upward from the base, beginning with attaching the first connectors 20 to the rear of the base body 91 using fasteners 100 as described with reference to FIGS. 6 and 16. In the embodiment of FIG. 16, two first connectors 20 are each attached at the rear corners of the square base body 91. The first connectors 20 are oriented such that the protrusions 29 extend in the direction of the center of the base 90. A first rod 30 is attached to each of the protrusions 29 of the first connectors 20 on the base 90. As described above, the first end of the first rods 30 can slidably mate with the protrusions 29, and the mating connection can be additionally secured by a screw 104 shown in FIG. 6. The first rods 30 extending from the first connectors at the rear of the base 90 connect at a second end to the third connector 50.

Figure 5:
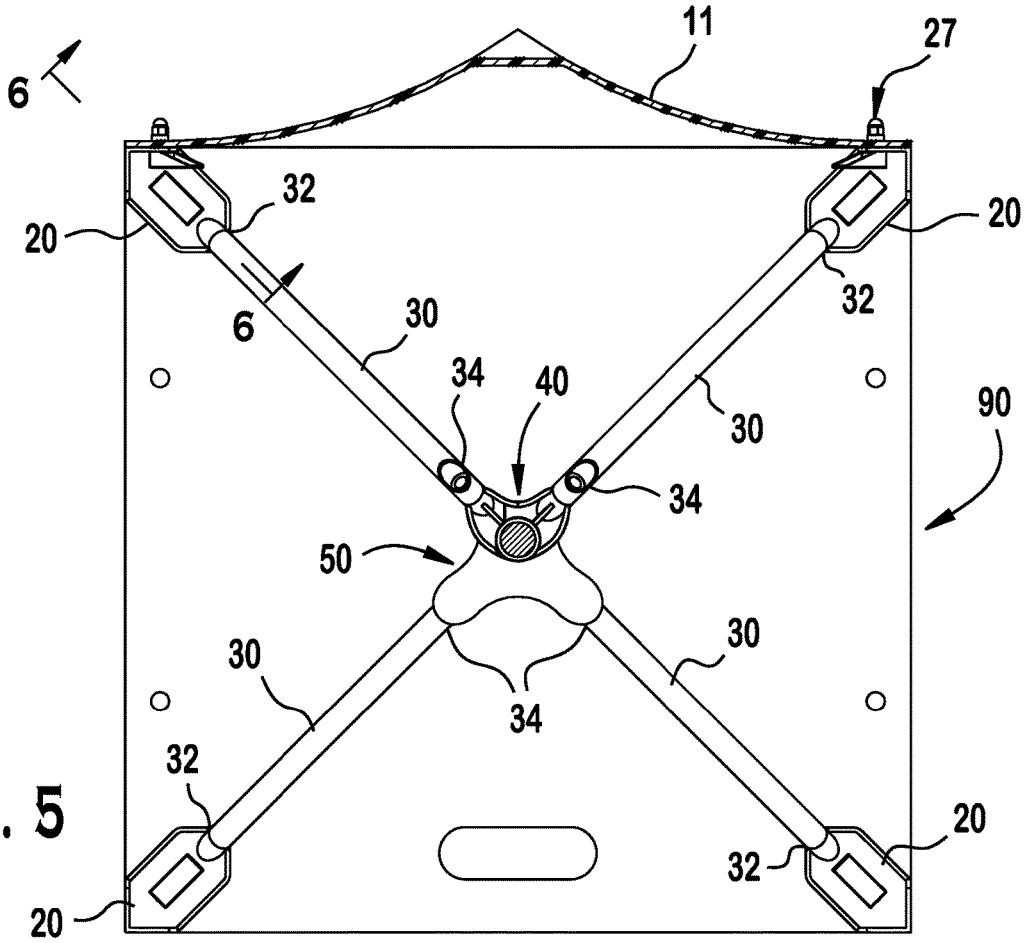
FIG. 5 is a top sectional view of the modular display system.
Figure 6:
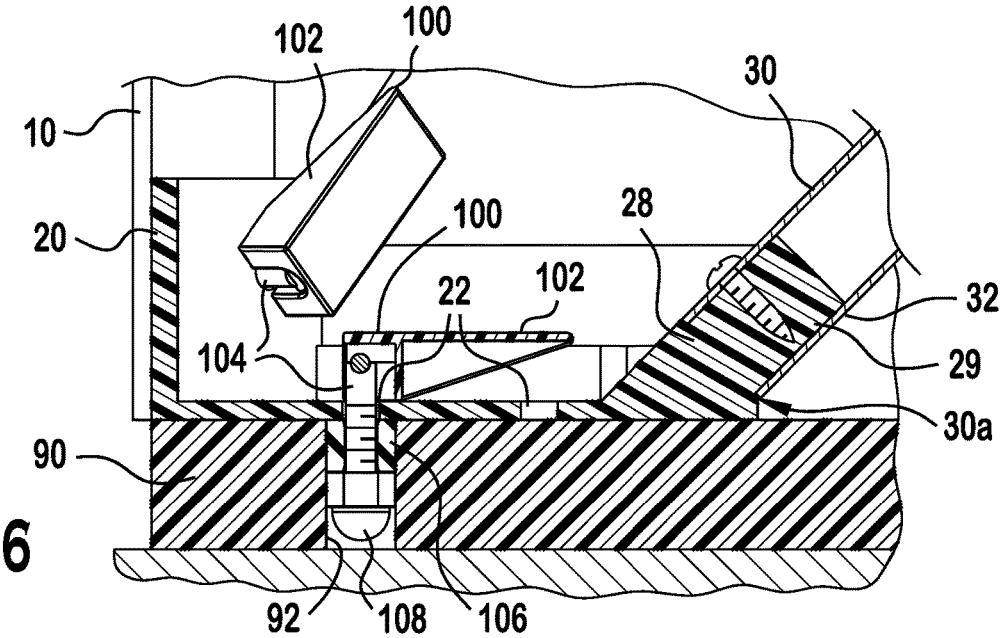
FIG. 6 is a sectional view of the modular display system, taken along line 6-6 of FIG. 5.

The modular panel assembly 100 is attached to the front of the base body 91, such that the second connector 40 is positioned over the center of the base body 91, and abuts the third connector 50, as shown in FIG. 5. The third rods 80 is then inserted into the opening 48 of second connector 40 to connect second connector 40 and third connector 50, as described above with reference to FIG. 11. This connection forms a quadpod extending up from base 90 as shown in FIGS. 2 and 16.

The resulting assembly is a base body 91 connected to an orthogonally positioned modular panel assembly 100, wherein the first rods 30 connect the modular panel 10 to the second connector 40, and the first rods 30 connect the base body 91 to both the second connector 40 and the third connector 50.

To complete the side support section 110, another modular panel assembly 100 is attached atop the first modular panel assembly 100 connected to the base body 91. The adjacent first connectors 20 are connected with fasteners 100, as described above with reference to FIGS. 18 and 19. The third rods 80 extending from the base second connector 40 and third connector 50 is connected to the top second connector 40 using an end member 60, as described above with reference to FIG. 30. This forms a side support section 110 of the display system 1 including a plurality of modular panels 10 and a base 90, shown in FIG. 16. The side support section 110 shown in FIG. 16 includes two modular panels 10, but one with ordinary skill in the art would appreciate that the side support section could include any number of vertically connected modular panels 10.

A user can also connect two adjacent modular panel assemblies 100 when the second connectors 40 are orthogonal to one another. This is shown, for example, in the connection between the top panel of the vertically extending side support section 110 and the adjacent, laterally extending modular panel assembly 100 shown in FIG. 2. In such a connection, the adjacent first connectors 20 are connected according to the description above with reference to FIGS. 18 and 20. A second rod 70 extends from the second connector 40 of the lateral modular panel assembly 100, and connects to the orthogonal second connector 40 via the end loop 71 as described above with reference to FIG. 30. The end member 60 is used to secure the end loop 71 and second rod 70 to the second connector 40 of the top panel of the vertically extending side support section 110, thus connecting vertically connected modular panel assemblies 100 within 110 to a laterally extending modular panel assembly 100.

Figure 34:
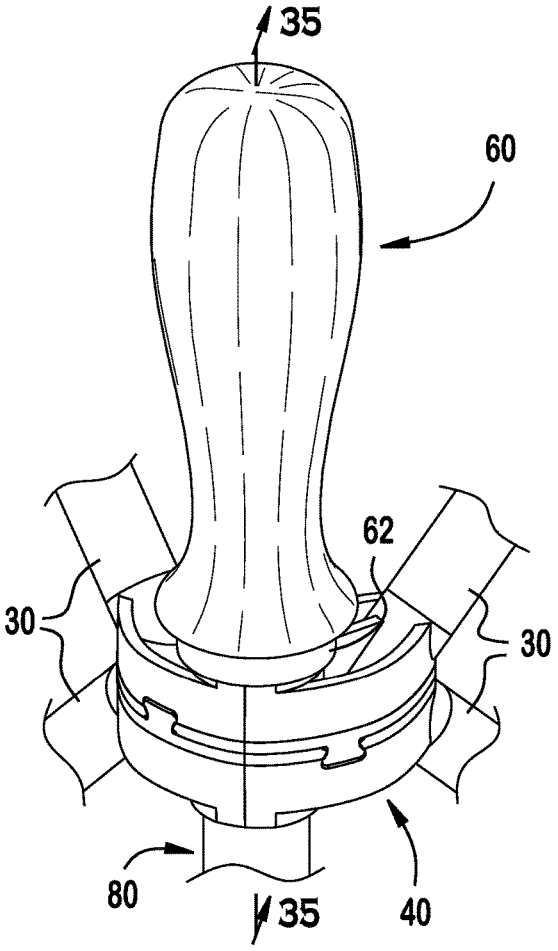
FIG. 34 is a perspective view of an end member and a second connector of a modular display system according to the invention.
Figure 35:
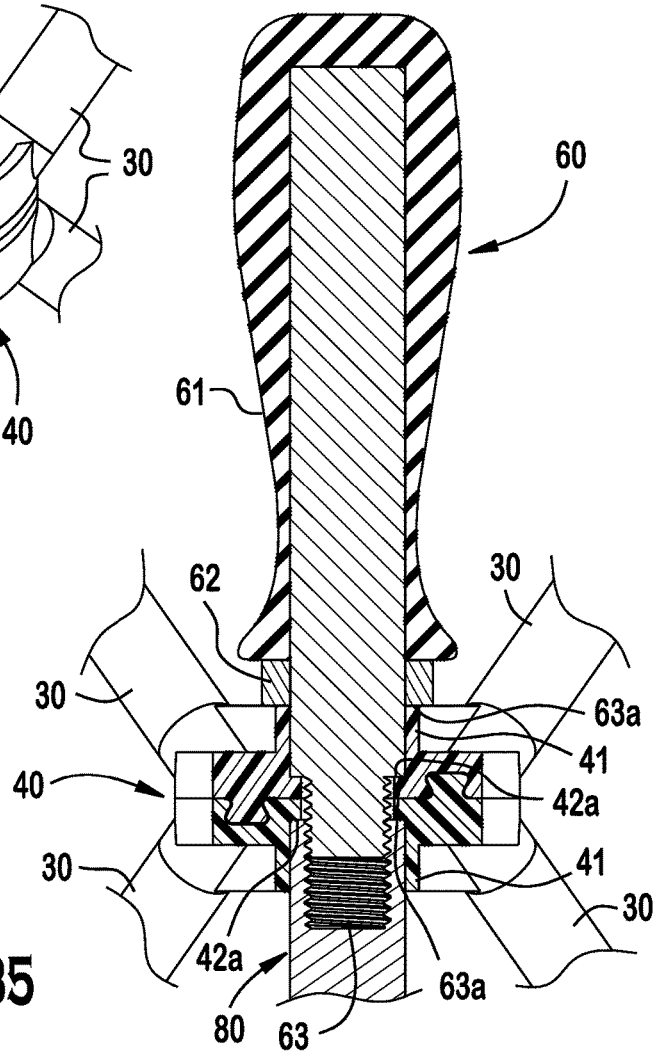
FIG. 35 is a sectional view of the end member and second connector of FIG. 34, taken along line 35-35.

FIGS. 1 and 2 show only one example of the variety of modular displays 1 that can be created using the above description. FIGS. 16, 34, and 35 show an alternative embodiment in which the modular display is only the side support section 110, when only a vertical display is desired. In this embodiment, shown best in FIGS. 34 and 35, the end member 60 is connected directly to the second connector 40, and does not additionally connect an end loop 71 as in FIG. 1 above. The resultant display system 1 is created such that display elements 12 are oriented for viewing.

The foregoing illustrates some of the possibilities for practicing the invention. Many other embodiments are possible within the scope and spirit of the invention. The disclosed invention utilizes the above identified components, as a system, in order to more efficiently construct a display system 1 for a particular purpose. Therefore, more or less of the aforementioned components can be used to conform to that particular purpose. It is, therefore, intended that the foregoing description be regarded as illustrative rather than limiting, and that the scope of the invention is given by the appended claims together with their full range of equivalents.

What is claimed is:

1. A display system, comprising:

a first modular panel having a display element;

a plurality of first connectors connected to the first modular panel;

a plurality of first rods having a distal end connected to the plurality of first connectors; and a plurality of second connectors engaging with proximal ends of the plurality of first rods, each second connector of the plurality of second connectors includes a mating element having a dovetail connector that matingly and removably connects the plurality of second connectors to each other.

2. The display system according to claim 1, wherein each of the first connectors includes a plurality of fastener receiving passageways.

3. The display system according to claim 2, further comprising a plurality of fasteners, the fasteners extending through the plurality of fastener receiving passageways and connecting the first connectors to the first modular panel.

4. The display system according to claim 1, wherein the display element is disposed on a first side of the first modular panel.

5. The display system according to claim 4, wherein the plurality of first connectors are disposed on a second side of the first modular panel opposite the first side.

6. The display system according to claim 1, further comprising a base including a base body, a plurality of base connectors, a plurality of base rods, and a third connector.

7. The display system according to claim 6, wherein the plurality of base connectors are connected to the base body.

8. The display system according to claim 7, wherein the base body includes a plurality of base fastener receiving passageways.

9. The display system according to claim 8, further comprising a plurality of fasteners, the fasteners extending through the plurality of base fastener receiving passageways and connecting the base connectors to the base body.

10. The display system according to claim 7, wherein the plurality of base rods have a distal end connected to the plurality of base connectors.

11. The display system according to claim 10, wherein the third connector engages with the proximal ends of the plurality of base rods.

12. The display system according to claim 11, wherein the third connector includes a planar surface, a mating connector on a first side of the planar surface, and a plurality of cylindrical members on the opposite side of the planar surface extending away from the planar surface.

13. The display system according to claim 6, wherein the first modular panel is removably connected to the base.

14. The display system according to claim 13, wherein the plurality of first connectors of the first modular panel are removably connected to the base.

15. The display system according to claim 14, wherein a second connector of the plurality of first connectors of the first modular panel abuts the third connector.

16. The display system according to claim 15, further comprising a second modular panel removably connected to the first modular panel.

17. The display system according to claim 16, wherein first connectors of the first modular panel are connected to first connectors of the second modular panel.

18. The display system according to claim 17, further comprising a second rod, a proximal end of the second rod engaging with the second connector of the first modular panel and the third connector.

19. The display system according to claim 18, further comprising an end member, the end member engaging with the distal end of the second rod and a second connector of the second modular panel.

20. The display system according to claim 19, further comprising a third modular panel removably connected to the second modular panel.

21. The display system according to claim 20, wherein first connectors of the second modular panel are connected to first connectors of the third modular panel.

22. The display system according to claim 20, further comprising a third rod having a proximal end and an end loop on the distal end.

23. The display system according to claim 22, wherein the end loop of the third rod engages with the end member and a second connector of the second modular panel.

24. The display system according to claim 23, wherein the proximal end of the third rod engages with a second connector of the third modular panel.

25. The display system according to claim 1, further comprising a second modular panel removably connected to the first modular panel.

26. The display system according to claim 25, wherein the plurality of first connectors of the first modular panel are connected to a plurality of first connectors of the second modular panel.

27. The display system according to claim 26, further comprising a fourth rod connecting to a second connector of the plurality of second connectors of the first modular panel to a second connector of the second modular panel.

28. A display system, comprising:

a first modular panel having a display element;

a plurality of first connectors connected to the first modular panel;

a plurality of first rods having a distal end connected to the plurality of first connectors;

a plurality of second connectors engaging with proximal ends of the plurality of first rods;

a base removably connected to the first modular panel and the plurality of first connectors, the base having a base body, a plurality of base connectors, a plurality of base rods, and a third connector abuts one of the plurality of second connectors;

a second modular panel removably connected to the plurality of first connectors of the first modular panel; and a second rod having a proximal end engaging with one of the plurality of second connectors of the first modular panel and the third connector.

29. The display system according to claim 28, further comprising an end member, the end member engaging with the distal end of the second rod and the second connector of the second modular panel.

30. The display system according to claim 29, further comprising a third modular panel removably connected to the second modular panel.

31. The display system according to claim 30, wherein first connectors of the second modular panel are connected to first connectors of the third modular panel.

32. The display system according to claim 31, further comprising a third rod having a proximal end and an end loop on the distal end.

33. The display system according to claim 32, wherein the end loop of the third rod engages with the end member and a second connector of the second modular panel.

34. The display system according to claim 33, wherein the proximal end of the third rod engages with a second connector of the third modular panel.

* * * * *